US010954091B2

(12) United States Patent
Ohashi et al.

(10) Patent No.: US 10,954,091 B2
(45) Date of Patent: Mar. 23, 2021

(54) MEDIUM PROCESSING APPARATUS, POST-PROCESSING APPARATUS, AND MEDIUM TRANSPORTING APPARATUS

(71) Applicant: SEIKO EPSON CORPORATION, Tokyo (JP)

(72) Inventors: Kazuyoshi Ohashi, Matsumoto (JP); Akinobu Nakahata, Shiojiri (JP); Tsuyoshi Furumido, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 194 days.

(21) Appl. No.: 16/366,050

(22) Filed: Mar. 27, 2019

(65) Prior Publication Data

US 2019/0300318 A1 Oct. 3, 2019

(30) Foreign Application Priority Data

Mar. 30, 2018 (JP) ..... JP2018-069992
Sep. 12, 2018 (JP) ..... JP2018-170574

(51) Int. Cl.
*B65H 29/24* (2006.01)
*B65H 29/54* (2006.01)
*B41J 13/00* (2006.01)

(52) U.S. Cl.
CPC ..... *B65H 29/242* (2013.01); *B41J 13/0045* (2013.01); *B65H 29/54* (2013.01); *B65H 2404/7414* (2013.01); *B65H 2406/323* (2013.01)

(58) Field of Classification Search
CPC . B65H 5/224; B65H 5/36; B65H 7/00; B65H 7/20; B65H 29/24; B65H 29/241; B65H 29/242; B65H 29/245; B65H 29/246; B65H 29/247; B65H 29/54; B65H 29/56; B65H 2404/6112; B65H 2404/655; B65H 2404/693; B65H 2404/7414; B65H 2301/44734; B65H 2403/942; B65H 2406/32; B65H 2406/323; B65H 2405/11151; B65H 2801/27; B41J 13/0045
See application file for complete search history.

(56) References Cited

U.S. PATENT DOCUMENTS

2016/0176670 A1* 6/2016 Noso ..... B65H 31/02 271/306
2017/0068202 A1* 3/2017 Nakano ..... G03G 15/6538
2017/0183189 A1* 6/2017 Matsuki ..... B65H 33/08

FOREIGN PATENT DOCUMENTS

JP 2008-266020 A 11/2008

* cited by examiner

*Primary Examiner* — Prasad V Gokhale
(74) *Attorney, Agent, or Firm* — Workman Nydegger

(57) ABSTRACT

A suction mechanism for suctioning a loop transporting belt a medium processed by a processing unit, a rotation mechanism for rotating the transporting belt, a stacker for stacking the medium transported by the transporting belt, and a change mechanism for changing a movable area are included. The rotation mechanism, after suctioning the medium to the transporting belt to rotate in a first rotation direction to transport the medium in a first transport direction, rotates the transporting belt in a second rotation direction to transport the medium in a second transport direction to stack the medium on a stacker. The change mechanism narrows a movable area when the medium is transported in the second transport direction compared to an area when the medium is transported in the first transport direction.

12 Claims, 28 Drawing Sheets

MEDIUM PROCESSING APPARATUS, POST-PROCESSING APPARATUS, AND MEDIUM TRANSPORTING APPARATUS

CROSS REFERENCES TO RELATED APPLICATIONS

The entire disclosure of Japanese Patent Application Nos. 2018-069992, filed Mar. 30, 2018 and 2018-170574, filed Sep. 12, 2018 are expressly incorporated by reference herein.

BACKGROUND

1. Technical Field

The present disclosure relates to a medium processing apparatus for processing a medium, a post-processing apparatus included in the medium processing apparatus, and a medium transporting apparatus.

2. Related Art

Examples of a post-processing apparatus include an integrated device disclosed in JP-A-2008-266020. The integrated device includes a suction conveyor which suctions a planographic printing plate, which is an example of a medium, from above and transports the suctioned plate. The suction conveyor, from above, drops the planographic printing plate that is suctioned and transported and accumulates it on an accumulation table which is an example of a stacker.

When a medium recorded by a printing apparatus which ejects liquid to record is stacked on a stacker using a technique disclosed in JP-A-2008-266020, a problem arises specific to the medium recorded by the printing apparatus using the liquid. In particular, it is known that a medium to which an aqueous liquid recording material adheres curls. Examples of the aqueous liquid recording material include an aqueous ink.

A medium may curl even when absorbing moisture in the air. For example, also when a medium wound in a roll shape is unwound and transported, the medium may curl because the medium has been rolled up for a long time. A medium may curl due to a shape of a transport path, or when an end of the medium is pressed.

There was a risk that when an attempt is made to stack a curled medium on a stacker, the medium cannot be properly stacked on the stacker. In other words, when a subsequent medium is stacked on a medium stacked on the stacker in advance, since the subsequent medium is curled, an end of the subsequent medium in a transport direction is transported while being in contact with the preceding medium in some cases. In this way, there was a risk that the subsequent medium is stacked on the stacker in a state in which the end is positioned between the preceding medium and the subsequent medium, specifically, in a state in which one end of the subsequent medium in the transport direction of the medium is curled towards a direction of another end thereof.

SUMMARY

According to a first aspect of the disclosure, a medium processing apparatus includes a processing unit for processing a medium, a suction mechanism for suctioning a loop transporting belt the medium processed by the processing unit, a rotation mechanism for rotating the transporting belt in a first rotation direction and in a second rotation direction opposite to the first rotation direction, a stacker for stacking the medium transported by the transporting belt, and a change mechanism for changing an area in which the medium is displaceable in a space between the transporting belt and the stacker. The suction mechanism suctions a second surface of the medium, which is on an opposite side of the medium from a stacker-side first surface, to the transport belt. The rotation mechanism, after suctioning the medium to the transporting belt to rotate in the first rotation direction to transport the medium in a first transport direction, rotates the transporting belt in the second rotation direction to transport the medium in a second transport direction to stack the medium on the stacker. The change mechanism narrows the area when the medium is transported in the second transport direction compared to an area when the medium is transported in the first transport direction.

According to a second aspect of the present disclosure, a post-processing apparatus includes a suction mechanism for suctioning a discharged medium to a loop transporting belt a discharged medium, a rotation mechanism for rotating the transporting belt in a first rotation direction and in a second rotation direction opposite to the first rotation direction, an intermediate stacker for stacking the medium transported by the transporting belt, a post-processing mechanism for performing post-processing on the medium stacked on the intermediate stacker, a discharging stacker for stacking the medium delivered from the intermediate stacker, and a change mechanism for changing an area in which the medium is displaceable between the transporting belt and the intermediate stacker. The suction mechanism suctions a second surface of the medium, which is on an opposite side of the medium from a stacker-side first surface, to the transport belt. The rotation mechanism, after suctioning the medium to the transporting belt to rotate in the first rotation direction to transport the medium in a first transport direction, rotates the transporting belt in the second rotation direction to transport the medium in a second transport direction to stack the medium on the intermediate stacker. The change mechanism narrows the area when the medium is transported in the second transport direction compared to an area when the medium is transported in the first transport direction.

According to a third aspect of the disclosure, a medium transporting apparatus includes a suction mechanism for suctioning a discharged medium to a loop transporting belt, a rotation mechanism for rotating the transporting belt in a first rotation direction and in a second rotation direction opposite to the first rotation direction, a stacker for stacking the medium transported by the transporting belt, and a change mechanism for changing an area in which the medium is displaceable in a space between the transporting belt and the stacker. The suction mechanism suctions a second surface of the medium, which is on opposite side of the medium from a stacker-side first surface, to the transport belt. The rotation mechanism, after suctioning the medium to the transporting belt to rotate in the first rotation direction to transport the medium in a first transport direction, rotates the transporting belt in the second rotation direction to transport the medium in a second transport direction to stack the medium on the stacker. The change mechanism narrows the area when the medium is transported in the second transport direction compared to an area when the medium is transported in the first transport direction.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

First Embodiment

Hereinafter, a medium processing apparatus, a post-processing apparatus, and a medium transporting apparatus according to a first embodiment will be described with reference to the accompanying drawings. The medium processing apparatus is, for example, an ink jet printer that ejects ink, which is an example of liquid, onto a medium, such as a paper sheet, and records a character or an image on the medium.

Figure 1:
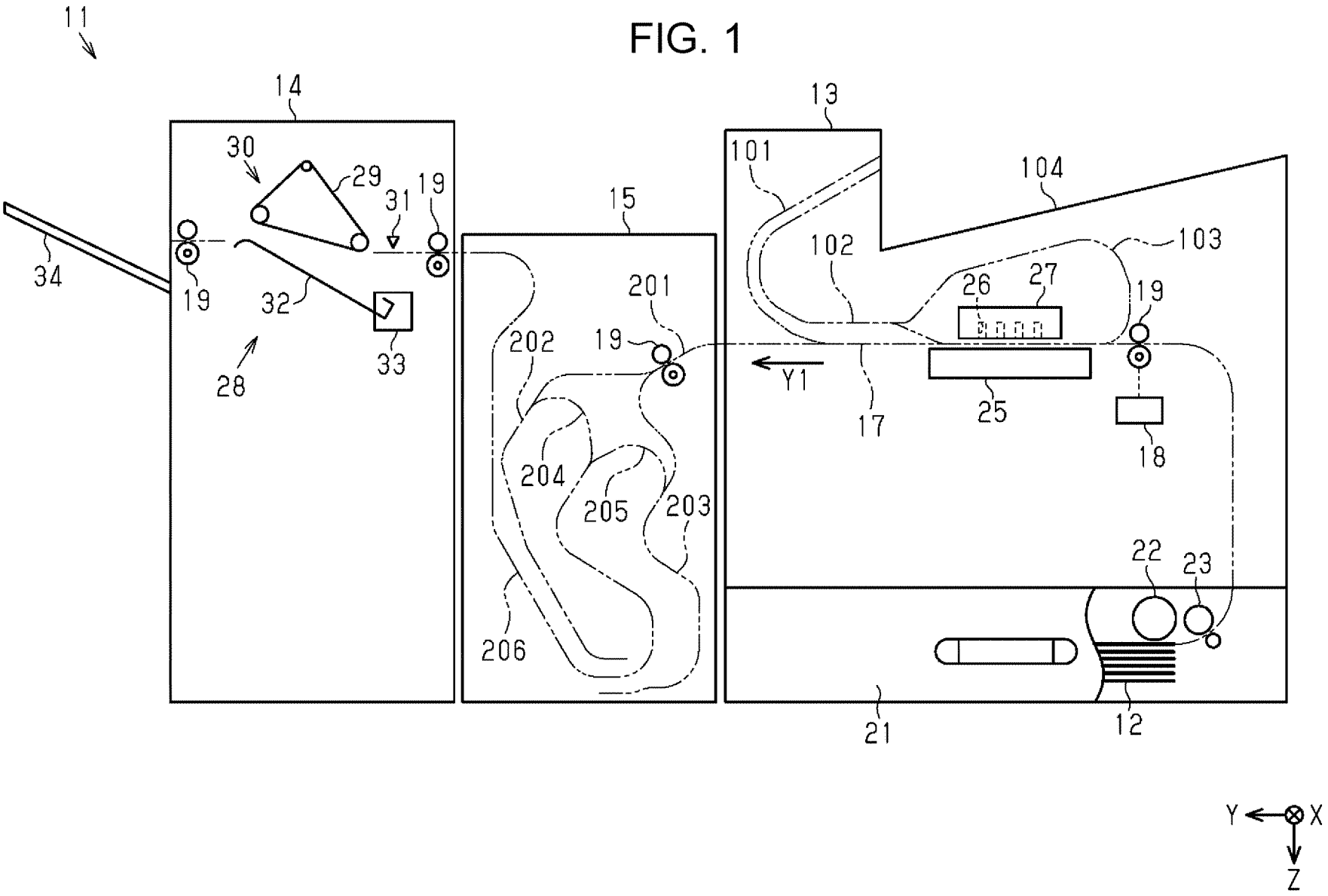
FIG. 1 is a schematic side view of a medium processing apparatus including a post-processing apparatus according to a first embodiment.

As shown in FIG. 1, a medium processing apparatus 11 includes a printing apparatus 13 that performs pre-processing that is an example of processing on a medium 12, a post-processing apparatus 14 that performs post-processing on the medium 12 subjected to the pre-processing, and an intermediate apparatus 15 that is positioned between the printing apparatus 13 and the post-processing apparatus 14. The pre-processing is a recording process in which a character or an image is recorded on the medium 12. The post-processing is a process performed accompanying the recording process, and in the post-processing apparatus 14 according to the present embodiment, a stapler process for stapling a plurality of the recorded media 12 is performed.

The medium processing apparatus 11 is provided with a transport path 17 indicated by a dashed-two dotted line in FIG. 1 which continues from the printing apparatus 13 via the intermediate apparatus 15 to the post-processing apparatus 14. The medium processing apparatus 11 includes at least one transport roller pair 19 for transporting the medium 12 along the transport path 17 by driving a transport motor 18. Note that as for the transport roller pair 19 in the intermediate apparatus 15 or the post-processing apparatus 14, each apparatus may include the transport motor 18. Further, the printing apparatus 13, the intermediate apparatus 15, or the post-processing apparatus 14 may include a plurality of the transport motors 18. In this way, it is possible to efficiently control operations of a plurality of the transport roller pairs 19 in the printing apparatus 13, the intermediate apparatus 15, or the post-processing apparatus 14.

In the drawing, a direction of gravity is indicated by a Z-axis assuming that the medium processing apparatus 11 is placed on a horizontal plane, and respective directions along a plane intersecting with the Z-axis are indicated by an X-axis and a Y-axis. The X, Y, and Z axes are preferably orthogonal to each other, and the X and Y axes are along the horizontal plane. In the following description, an X-axis direction is also referred to as a width direction X, and a Z-axis direction is also referred to as a vertical direction Z, and a direction orthogonal to the width direction X and along the transport path 17 is also referred to as a first transport direction Y1. The first transport direction Y1 is a direction in which the transport roller pair 19 transports the medium 12, and is a direction heading from the printing apparatus 13 on an upstream side toward the post-processing apparatus 14 on a downstream side.

A cassette 21 capable of storing the media 12 in a stacked state is removably provided in the printing apparatus 13. A plurality of cassettes 21 may be removably provided in the printing apparatus 13. The printing apparatus 13 includes a pickup roller 22 for delivering the uppermost medium 12 out of the media 12 stored in the cassette 21, and a separation roller 23 for separating the media 12 delivered by the pickup roller 22 sheet by sheet.

The printing apparatus 13 includes a support unit 25 that is provided at a position along the transport path 17 and supports the medium 12, and a recording head 27 that is an example of a processing unit that ejects liquid from a nozzle 26 to the medium 12 supported by the support unit 25 and performs a recording process. The recording head 27 is provided at a position facing the support unit 25 with the transport path 17 interposed therebetween. The recording head 27 may be a so-called line head capable of simultaneously ejecting liquid in the width direction X, or may be a so-called serial head for ejecting liquid while moving in the width direction X.

The printing apparatus 13 includes, as part of the transport path 17, a discharge path 101 through which the medium 12 is discharged, a switchback path 102 through which the medium 12 is subject to switchback transporting, and an inversion path 103 in which posture of the medium 12 is inverted. The discharge path 101 is a path through which the medium 12 subjected to recording by the recording head 27 is discharged toward a discharge unit 104. The discharge unit 104 is positioned at an upper portion of the printing apparatus 13. The medium 12 transported through the discharge path 101 is mounted on the discharge unit 104.

The switchback path 102 and the inversion path 103 are paths through which the medium 12 to be subject to duplex printing is transported. The switchback path 102 extends along the discharge path 101. The inversion path 103 extends from the switchback path 102. The inversion path 103 extends from a downstream side of the recording head 27 toward an upstream side of the recording head 27 so as to pass over the recording head 27.

When the duplex printing is performed, the medium 12 with one side printed is first transported to the switchback path 102. Next, the medium 12 is subject to the switchback transporting in the switchback path 102. In other words, the medium 12 is transported in an inverse direction in the switchback path 102. Next, the medium 12 is transported from the switchback path 102 to the inversion path 103.

The medium 12 is transported through the switchback path 102 and the inversion path 103, so that posture of the printed one side is inverted from an upward direction to a downward direction. The medium 12 transported through the inversion path 103 is subject to the recording again by the recording head 27. At this time, the printing is performed on a surface opposite to the already printed surface of the medium 12. In this manner, the printing apparatus 13 performs the duplex printing on the medium 12. The printing apparatus 13 transports the printed medium 12 toward the discharge unit 104 or the intermediate apparatus 15.

The intermediate apparatus 15 includes, as part of the transport path 17, an introduction path 201, a first switchback path 202, a second switchback path 203, a first merging path 204, a second merging path 205, and a lead-out path 206. The introduction path 201 is a path through which the medium 12 is introduced from the printing apparatus 13. The first switchback path 202 and the second switchback path 203 extend from the introduction path 201, and the medium 12 is subject to the switchback transporting in them. The first switchback path 202 and the second switchback path 203 extend so as to branch from the introduction path 201.

The first merging path 204 is a path extending from the first switchback path 202. The second merging path 205 is a path extending from the second switchback path 203. The lead-out path 206 extends from the first merging path 204 and the second merging path 205, and is a path through which the medium 12 is led out toward the post-processing apparatus 14. The first merging path 204 and the second merging path 205 merge into the lead-out path 206.

The medium 12 transported from the printing apparatus 13 to the intermediate apparatus 15 is transported through the introduction path 201. The medium 12 transported through the introduction path 201 is transported to either the first switchback path 202 or the second switchback path 203. The media 12 transported through the introduction path 201 are distributed to the first switchback path 202 and the second switchback path 203 by a flap or the like provided at a point at which the introduction path 201 branches into the first switchback path 202 and the second switchback path 203.

The medium 12 transported to the first switchback path 202 is subject to the switchback transporting in the first switchback path 202. The medium 12 is subject to the switchback transporting in the first switchback path 202, and then transported to the first merging path 204. The medium 12 transported through the first merging path 204 is transported to the lead-out path 206.

The medium 12 transported from the introduction path 201 to the second switchback path 203 is subject to the switchback transporting in the second switchback path 203. The medium 12 is subject to the switchback transporting in the second switchback path 203, and then transported to the second merging path 205. The medium 12 transported through the second merging path 205 is transported to the lead-out path 206.

The medium 12 transported through the intermediate apparatus 15 is subject to the switchback transporting in the first switchback path 202 or the second switchback path 203. Therefore, the medium 12 transported through the intermediate apparatus 15 is inverted so that posture of a surface which is printed immediately before in the printing apparatus 13 is inverted from the upward direction to the downward direction. Accordingly, the medium 12 to be led out to the post-processing apparatus 14 has a posture in which the surface printed immediately before in the printing apparatus 13 faces downward. By transporting the medium 12 to the intermediate apparatus 15, time to dry the medium 12 to which liquid is ejected is secured. By securing the drying time of the medium 12, it is possible to suppress transfer of the liquid ejected to the medium 12, curl of the medium 12 due to water content of the ejected liquid, and the like.

Next, the post-processing apparatus 14 according to an embodiment will be described.

As shown in FIG. 1, the post-processing apparatus 14 includes a medium transporting apparatus 28. The medium transporting apparatus 28 includes a transporting mechanism 30 in which a transporting belt 29 suctions and transports the medium 12. The medium transporting apparatus 28 may include a detection unit 31 that detects the medium 12 positioned on an upstream side of the transporting mechanism 30 in the first transport direction Y1. The medium transporting apparatus 28 includes an intermediate stacker 32 which is an example of a stacker for stacking the medium 12 transported by the transporting belt 29. The post-processing apparatus 14 includes a post-processing mechanism 33 for performing post-processing on the medium 12 stacked on the intermediate stacker 32, and a discharging stacker 34 for stacking the medium 12 delivered from the intermediate stacker 32.

Figure 2:
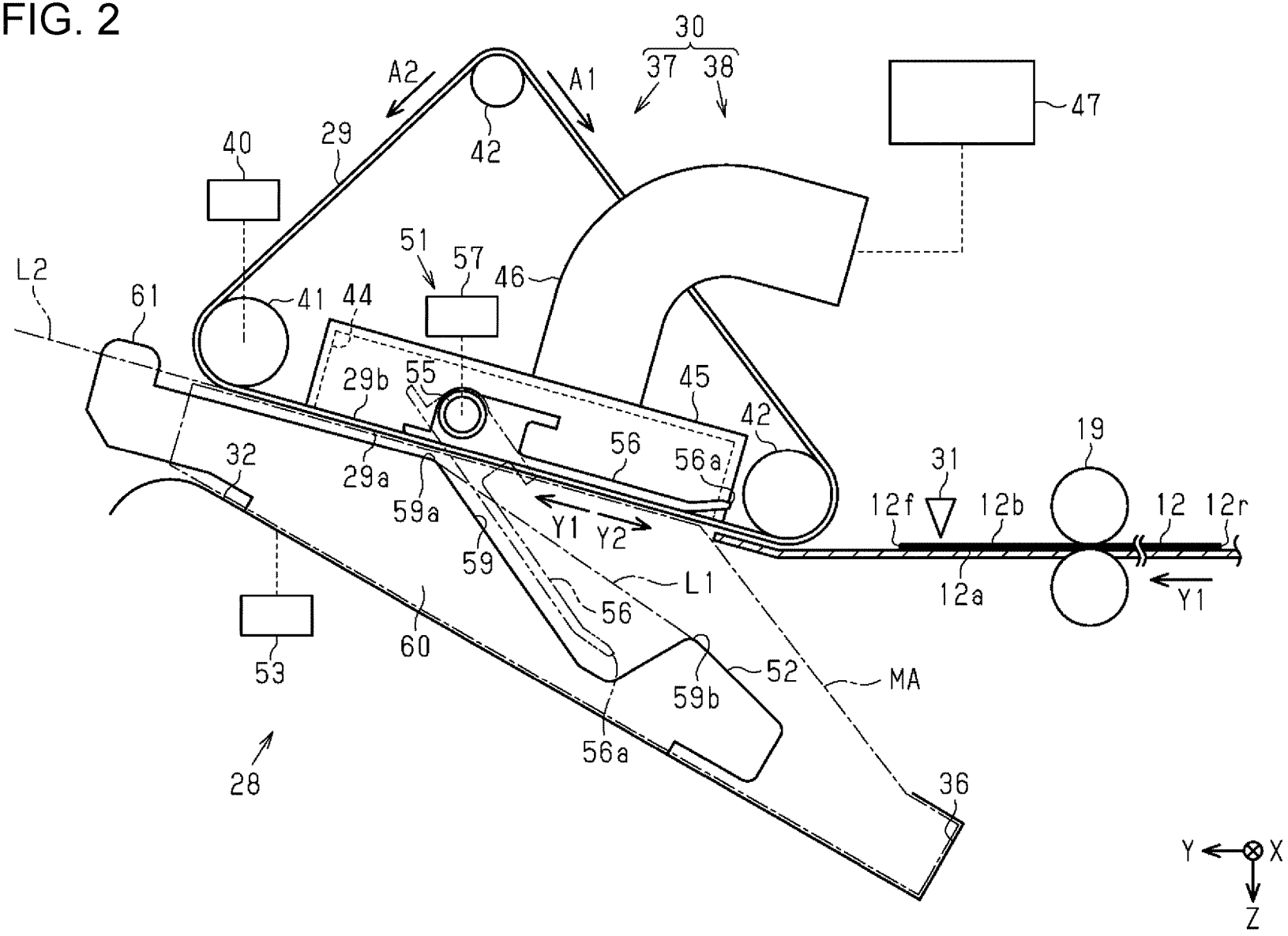
FIG. 2 is a schematic side view of a medium transporting apparatus included in the post-processing apparatus.

As shown in FIG. 2, the intermediate stacker 32 includes an adjustment portion 36 that adjusts a rear end 12*r* which is an end on an upstream side of the medium 12 to be stacked in the first transport direction Y1. The intermediate stacker 32 is provided obliquely so that an end on a side of the adjustment portion 36 is positioned on a lower side in the vertical direction Z than an end on an opposite side.

The transporting mechanism 30 is provided at an upper position in the vertical direction Z of the intermediate stacker 32 so that the intermediate stacker 32 and the transporting belt 29 face each other. The transporting mechanism 30 includes a rotation mechanism 37 for rotating the transporting belt 29, and a suction mechanism 38 for causing the loop transporting belt 29 to suction the medium 12 subjected to the recording process by the recording head 27 and discharged from the intermediate apparatus 15.

The rotation mechanism 37 includes a belt motor 40 which rotates the transporting belt 29, a drive pulley 41 which is rotated by drive of the belt motor 40, and a driven pulley 42 which is rotatable around an axis parallel to an axis of the drive pulley 41. The rotation mechanism 37 according to the present embodiment includes two the driven pulleys 42. The drive pulley 41 and the driven pulleys 42 are bridged with the transporting belt 29 in a triangular loop shape. The transporting belt 29 moves around an outer side of the drive pulley 41 and the driven pulleys 42 by the drive of the belt motor 40. Specifically, the rotation mechanism 37 rotates the transporting belt 29 in a first rotation direction A1 by normally rotating and driving the belt motor 40. By reversely rotating and driving the belt motor 40, the rotation mechanism 37 rotates the transporting belt 29 in a second rotation direction A2 which is opposite to the first rotation direction A1.

The suction mechanism 38 includes the transporting belt 29, a box-shaped draw-in unit 45 having a draw-in chamber 44, and a fan 47 for drawing in inside the draw-in chamber 44 via a duct 46. An outer surface of the transporting belt 29 is a suction surface 29*a* which suctions the medium 12. The draw-in unit 45 is provided in contact with an inner surface 29*b*, which is an inner surface of the transporting belt 29, so that part of the draw-in chamber 44 is covered with the transporting belt 29.

Figure 3:
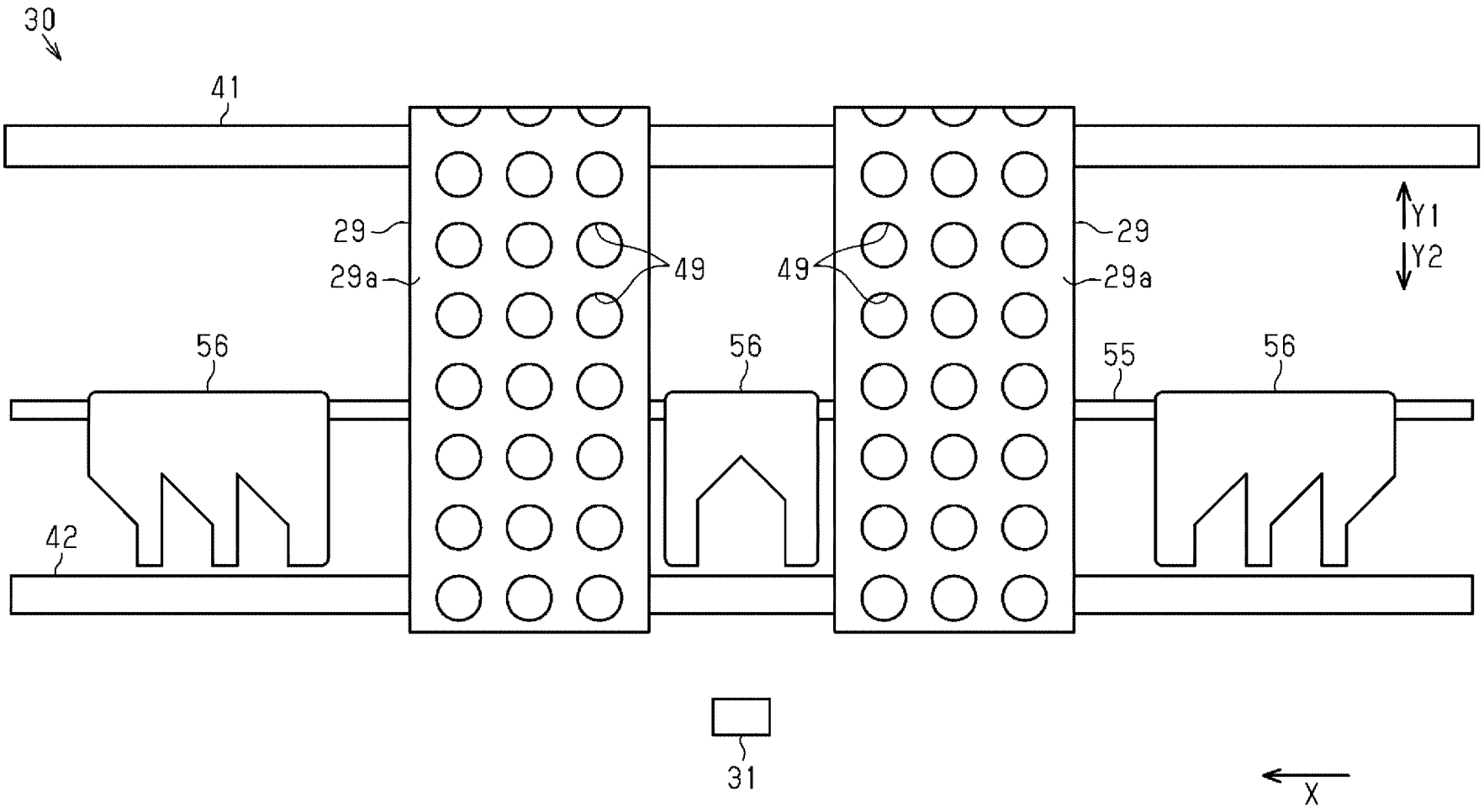
FIG. 3 is a schematic bottom view of a transporting belt.

As shown in FIG. 3, the drive pulley 41 and the driven pulleys 42 may be bridged with a plurality of the transporting belts 29 arranged side by side in the width direction X. Many holes 49 penetrating the transporting belt 29 are formed on the transporting belt 29 so as to open to the suction surface 29*a* and to the inner surface 29*b*.

As shown in FIG. 2 and FIG. 3, the suction mechanism 38 causes inner pressure of the draw-in chamber 44 to be negative along with driving of the fan 47, and causes the suction surface 29*a* of the transporting belt 29 to suction the medium 12 through the holes 49 communicating with the draw-in chamber 44. In other words, the suction mechanism 38 causes the transporting belt 29 to suction the medium 12 by a draw-in method in which the air is drawn in through the holes 49 formed on the transporting belt 29.

As shown in FIG. 2, the transporting mechanism 30 causes the transporting belt 29 to suction the medium 12 and rotates the transporting belt 29 in this state, thereby transporting the medium 12 in an area between the transporting belt 29 and the intermediate stacker 32. Specifically, the rotation mechanism 37 rotates the transporting belt 29 suctioning the medium 12 in the first rotation direction A1, thereby transporting the medium 12 in the first transport direction Y1. The rotation mechanism 37 rotates the transporting belt 29 suctioning the medium 12 in the second rotation direction A2, thereby transporting the medium 12 in a second transport direction Y2 opposite to the first transport direction Y1. After transporting the medium 12 in the first transport direction Y1, the rotation mechanism 37 transports the medium 12 in the second transport direction Y2 and stacks the medium 12 on the intermediate stacker 32.

As shown in FIG. 2, the medium transporting apparatus 28 includes a change mechanism 51 which changes a size of a movable area MA which is an example of an area in which the medium 12 can be displaced between the transporting belt 29 and the intermediate stacker 32. The post-processing apparatus 14 includes a pair of adjusting members 52 which adjusts the medium 12 stacked on the intermediate stacker 32 in the width direction X, and a moving mechanism 53 which moves the adjusting members 52 in the width direction X. In FIG. 2, one adjusting member 52 of the pair of adjusting members 52 is shown.

The change mechanism 51 includes a movable guide 56 which is rotatable around a guide shaft 55, and a guide motor 57 which rotates the guide shaft 55. The movable guide 56 is provided so as to be movable between a first guide position indicated by a solid line in FIG. 2 and a second guide position indicated by a dashed-two dotted line in FIG. 2 closer to the intermediate stacker 32 than the first guide position, by driving of the guide motor 57.

The guide shaft 55 is provided at an inner position of the transporting belt 29, so as to extend in the width direction X. The movable guide 56 positioned at the first guide position is positioned at a position farther from the intermediate stacker 32 than the transporting belt 29, and is positioned higher than a portion where the holes 49 communicating with the draw-in chamber 44 are formed on the suction surface 29*a*. When the movable guide 56 is positioned at the first guide position, an area between the transporting belt 29 and the intermediate stacker 32 becomes the movable area MA.

A portion of the movable guide 56 positioned at the second guide position is positioned at a position closer to the intermediate stacker 32 than the transporting belt 29, and intersects with the suction surface 29*a* viewed from the width direction X. When the movable guide 56 is positioned at the second guide position, the movable area MA is narrowed by the movable guide 56, and an area between the movable guide 56 and the intermediate stacker 32 becomes part of the movable area MA.

When the movable guide 56 is positioned at the first guide position, a tip 56*a* of the movable guide 56 distanced from the guide shaft 55 is positioned on a downstream side of the guide shaft 55 in the second transport direction Y2. The movable guide 56 positioned at the first guide position rotates so that the tip 56*a* is lowered and moves to the second guide position. Therefore, when the movable guide 56 is positioned at the second guide position, the movable area MA is narrower on a downstream side in the second transport direction Y2 than the movable area MA when the movable guide 56 is positioned at the first guide position.

The pair of adjusting members 52 is provided at a distance from each other in the width direction X. In the adjusting member 52, a notch 59 is formed for allowing movement of the movable guide 56 while avoiding contact with the movable guide 56 positioned at the second guide position, in an operation in which the adjusting member 52 adjusts the media 12. When positioned at the second guide position, the movable guide 56 can move while avoiding the adjusting member 52 via the notch 59. The adjusting member 52 includes an adjustment surface 60 that is an example of a first guide surface that contacts an end of the medium 12 in the width direction X to adjust the medium 12. The moving mechanism 53 moves the pair of adjusting members 52 in accordance with a size of the medium 12 stacked on the intermediate stacker 32, so that the adjustment surface 60 of the adjusting member 52 and an end of the medium 12 in the width direction X contact with each other. In other words, the pair of adjusting members 52 moves relatively in the width direction X.

In the notch 59, a first end 59*a*, which is an upstream end in the second transport direction Y2, and a second end 59*b*, which is a downstream end, are positioned at different positions in the vertical direction Z.

Specifically, the first end 59*a* is positioned above the second end 59*b* in the vertical direction Z and closer to the transporting belt 29. The first end 59*a* and the second end 59*b* are positioned above the tip 56*a* of the movable guide 56 positioned at the second guide position indicated by the dashed-two dotted line in FIG. 2 in the vertical direction Z, and positioned lower than the guide shaft 55 in the vertical direction Z. Accordingly, the movable guide 56 positioned at the second guide position intersects with a first imaginary line L1 connecting the first end 59*a* and the second end 59*b*.

The adjusting member 52 includes a projection portion 61 which is positioned above a second imaginary line L2 in the vertical direction Z, which is obtained by extending a straight line along the suction surface 29*a* downstream the first transport direction Y1. The projection portion 61 constitutes part of the adjustment surface 60. The projection portion 61 is positioned on an upper side of the notch 59 in the vertical direction Z. The projection portion 61 is adjusted with the drive pulley 41 in the first transport direction Y1 with the transporting belt 29 interposed therebetween.

Since the medium 12 is deformed at a position between the transporting belt 29 and the intermediate stacker 32, even when the medium 12 cannot abut on the adjusting member 52 and cannot be adjusted, the transporting belt 29 protrudes to an upper position in the vertical direction Z than the second imaginary line L2, thus the medium 12 can be reliably abutted on the projection portion 61, and adjusted.

Next, an electrical configuration of the medium processing apparatus 11 will be described.

Figure 4:
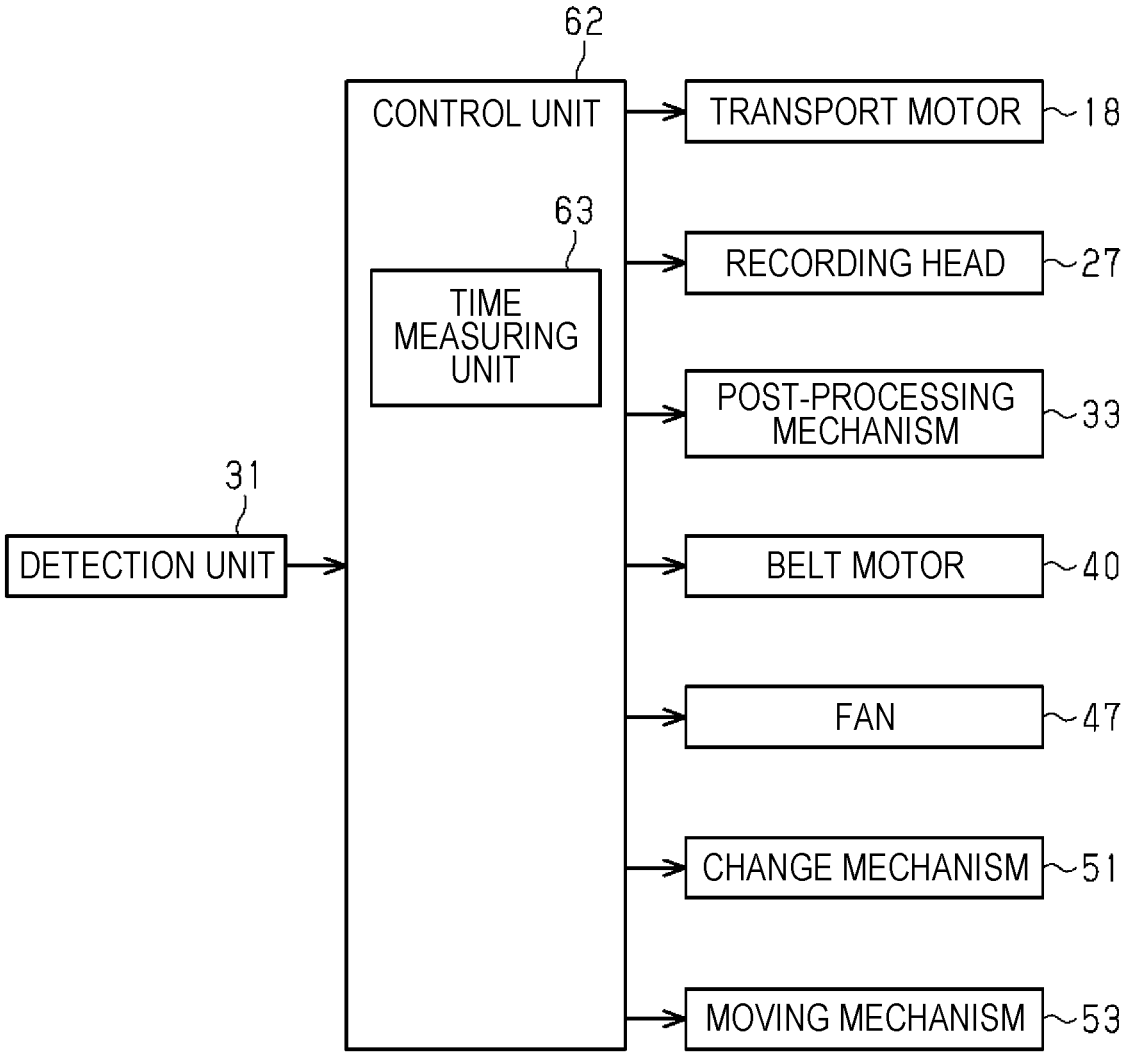
FIG. 4 is a block diagram showing an electrical configuration of the medium processing apparatus.

As shown in FIG. 4, the medium processing apparatus 11 includes a control unit 62 that comprehensively controls driving of each mechanism in the medium processing apparatus 11. The control unit 62 is constituted by, for example, a processing circuit including a computer and a memory, and the like. The control unit 62 controls various operations to be executed by the medium processing apparatus 11 in accordance with a program stored in the memory. The control unit 62 includes a time measuring unit 63 that measures time. The control unit 62 is connected with the detection unit 31 so as to be capable of receiving a signal. The control unit 62 transmits signals to the transport motor 18, the recording head 27, the post-processing mechanism 33, the belt motor 40, the fan 47, the change mechanism 51, and the moving mechanism 53, and controls operations of the respective mechanisms.

Next, an operation of the medium processing apparatus 11 will be described.

As shown in FIG. 2, when the medium 12 is transported in the first transport direction Y1 by the transport roller pair 19, the control unit 62 drives the fan 47 in a state in which the movable guide 56 is positioned at the first guide position indicated by a solid line in FIG. 2, and normally rotates and drives the belt motor 40 to rotate the transporting belt 29 in the first rotation direction A1.

Figure 5:
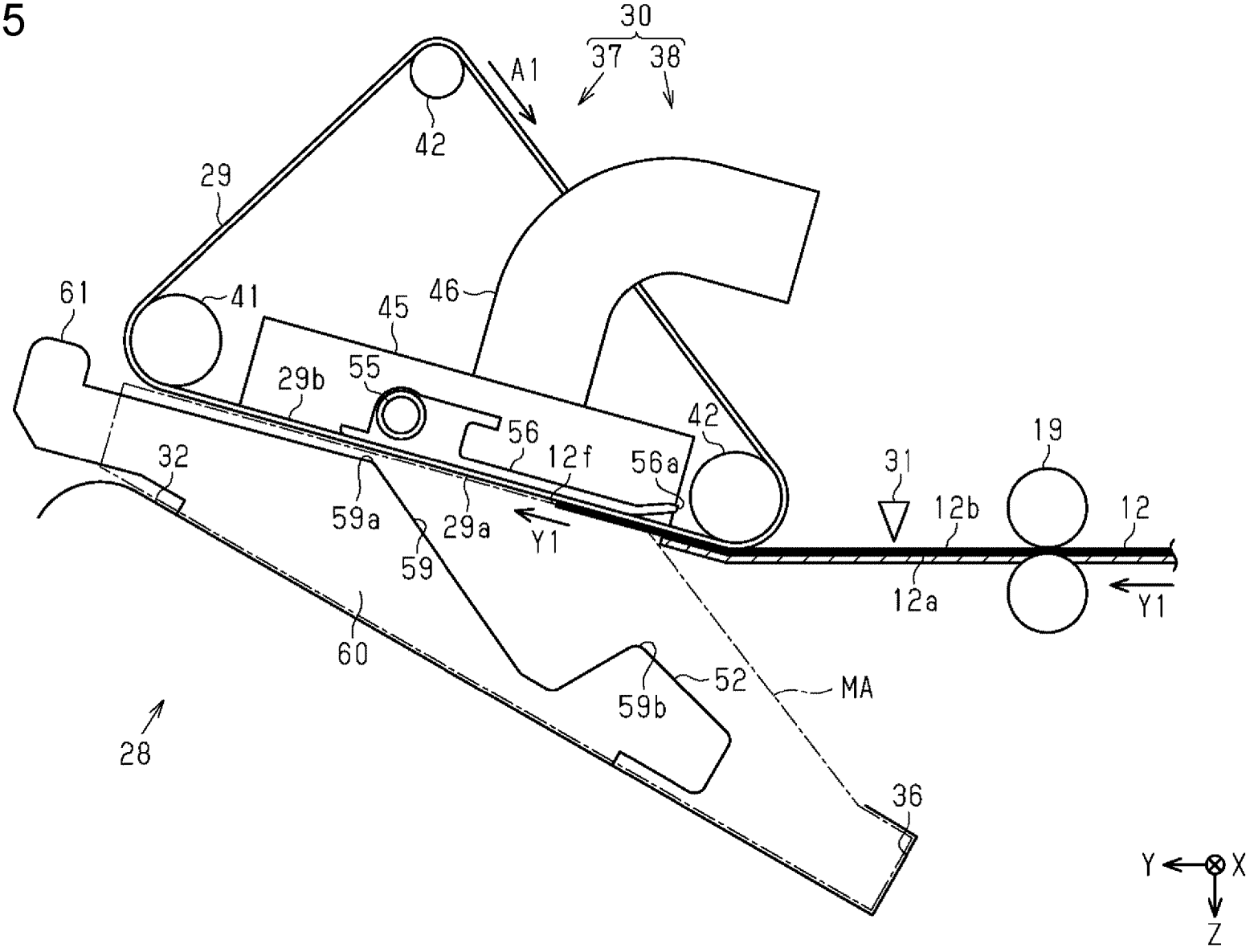
FIG. 5 is a schematic side view of the medium transporting apparatus in which the transporting belt suctions a medium.

As shown in FIG. 5, when the medium 12 is transported to the transporting belt 29, the suction mechanism 38 suctions an upper surface 12*b* which is an example of a second surface of the medium 12. The upper surface 12*b* of the medium 12 is a surface opposite to a lower surface 12*a*, which is an example of a first surface of the medium 12 on the intermediate stacker 32 side.

When the medium 12 is suctioned by the suction surface 29*a* and is transported in the first transport direction Y1 by the transporting belt 29 rotating in the first rotation direction A1, the movable guide 56 is positioned at the first guide position above the suction surface 29*a*. Therefore, the medium 12 is transported in the first transport direction Y1 in a state not in contact with the movable guide 56 or in a state of being along the movable guide 56.

Figure 6:
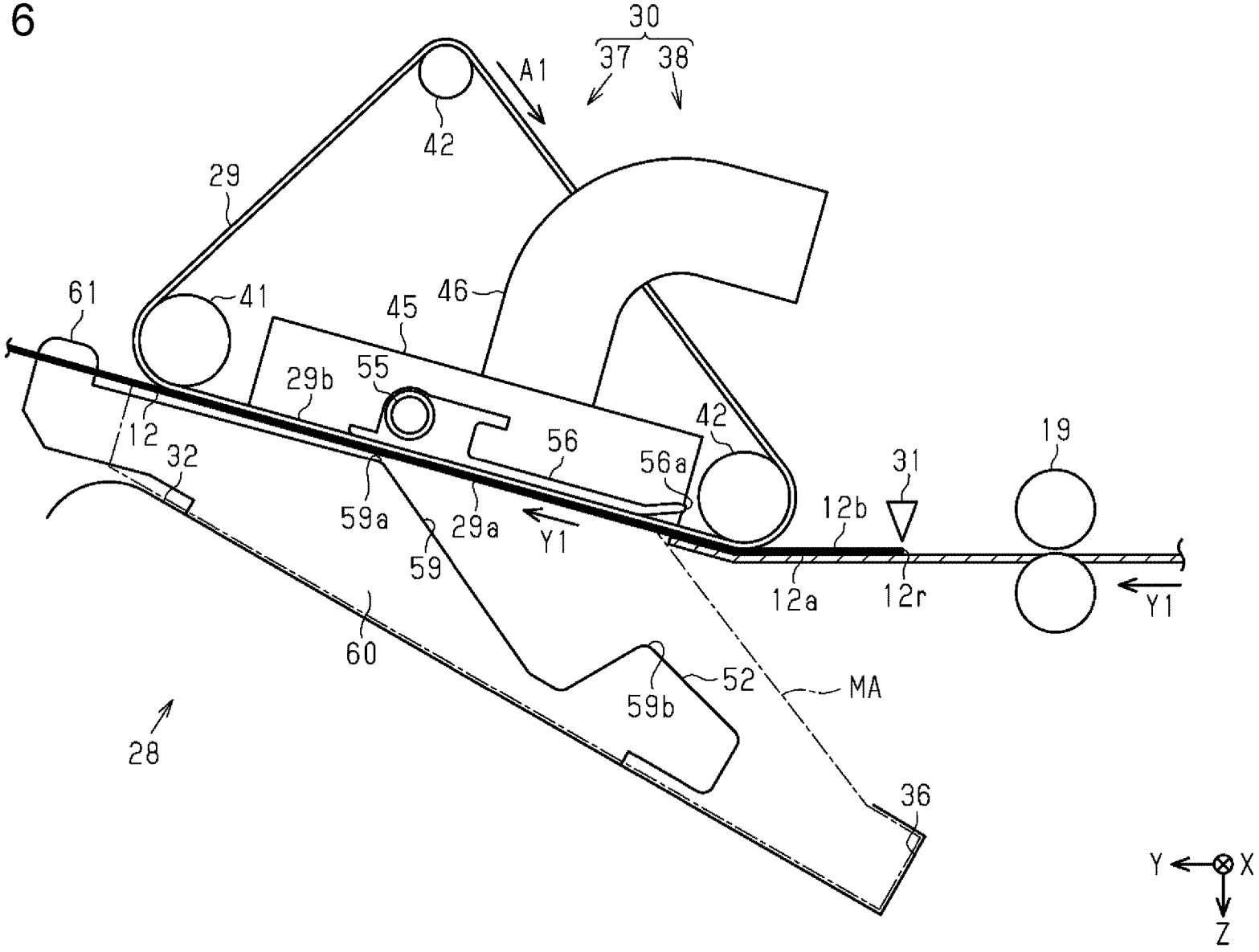
FIG. 6 is a schematic side view of the medium transporting apparatus which transports the suctioned medium in a first transport direction.

As shown in FIG. 6, when the detection unit 31 detects the rear end 12*r* of the medium 12, the control unit 62 moves the movable guide 56 to the second guide position after a lapse of a predetermined time period, and reversely rotates and drives the belt motor 40. In other words, when the rear end 12*r* is detected in a state in which the belt motor 40 is normally rotated and driven, the control unit 62 continues to normally rotate and drive the belt motor 40 for a predetermined time period and rotates the transporting belt 29 in the first rotation direction A1. After the lapse of the predetermined time period since the rear end 12*r* is detected, the control unit 62 temporarily stops driving of the belt motor 40, and then reversely rotates and drives the belt motor 40 to rotate the transporting belt 29 in the second rotation direction A2.

The predetermined time period is time required for the rear end 12*r* of the medium 12 to pass through the movable guide 56. The predetermined time period is substantially equal to a quotient obtained by dividing a distance along the transport path 17 from the detection unit 31 to a position where the movable guide 56 positioned at the second guide position and the suction surface 29*a* of the transporting belt 29 intersect with each other by a speed at which the medium 12 is transported. When a rotation direction of the transporting belt 29 is changed from the first rotation direction A1 to the second rotation direction A2 after the lapse of the predetermined time period, the medium 12 is temporarily stopped in a state in which the rear end 12*r* is positioned downstream the guide shaft 55 of the movable guide 56 in the first transport direction Y1.

Figure 7:
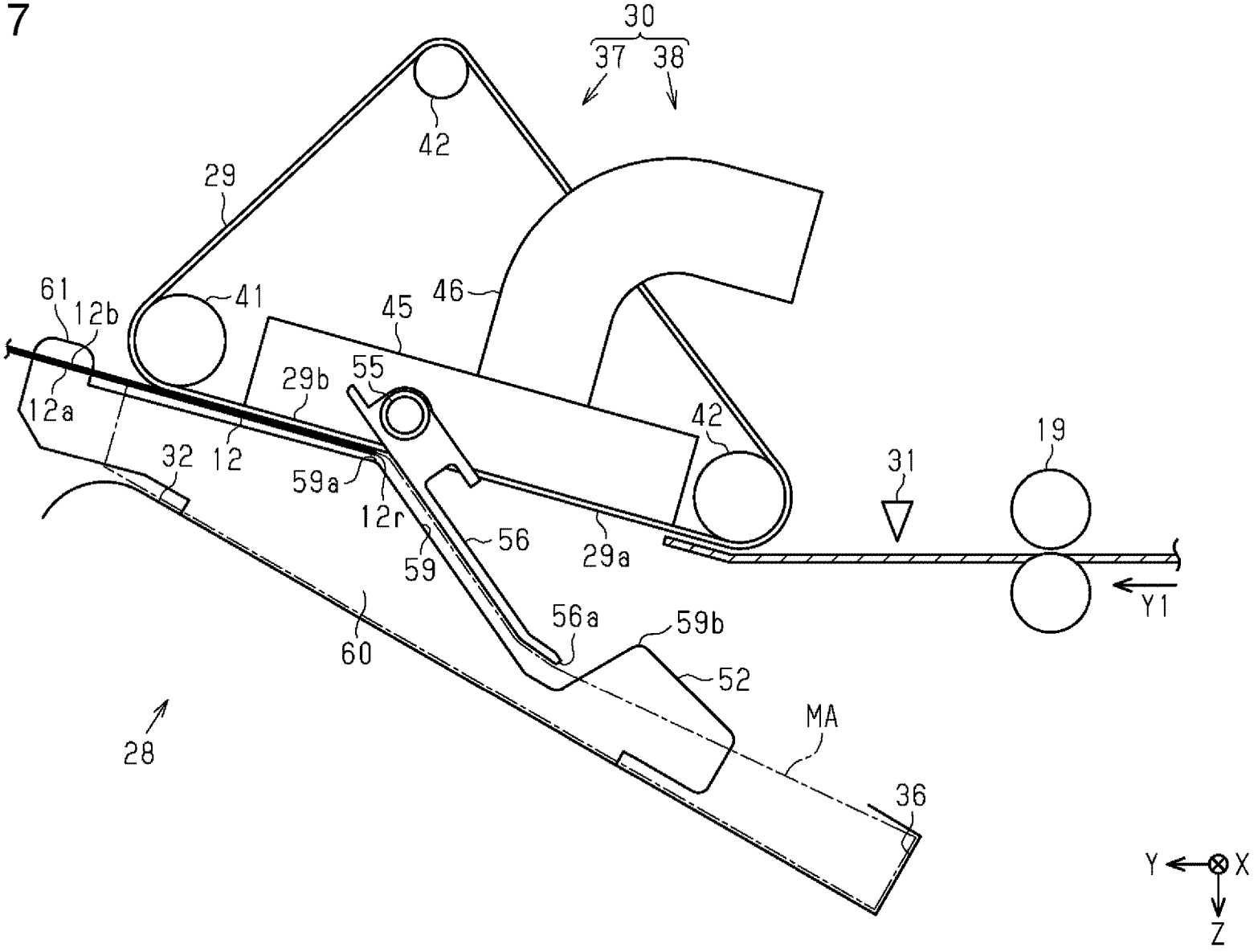
FIG. 7 is a schematic side view of the medium transporting apparatus when a rotation direction of the transporting belt is switched.

As shown in FIG. 7, while the transport of the medium 12 is stopped, the control unit 62 moves the movable guide 56 to the second guide position, and rotates the transporting belt 29 in the second rotation direction A2 in a state in which the movable guide 56 is positioned at the second guide position. In other words, the change mechanism 51 narrows a size of the movable area MA on the downstream side in the second transport direction Y2 when the medium 12 is transported in the second transport direction Y2, as compared with the case where the medium 12 is transported in the first transport direction Y1.

Figure 8:
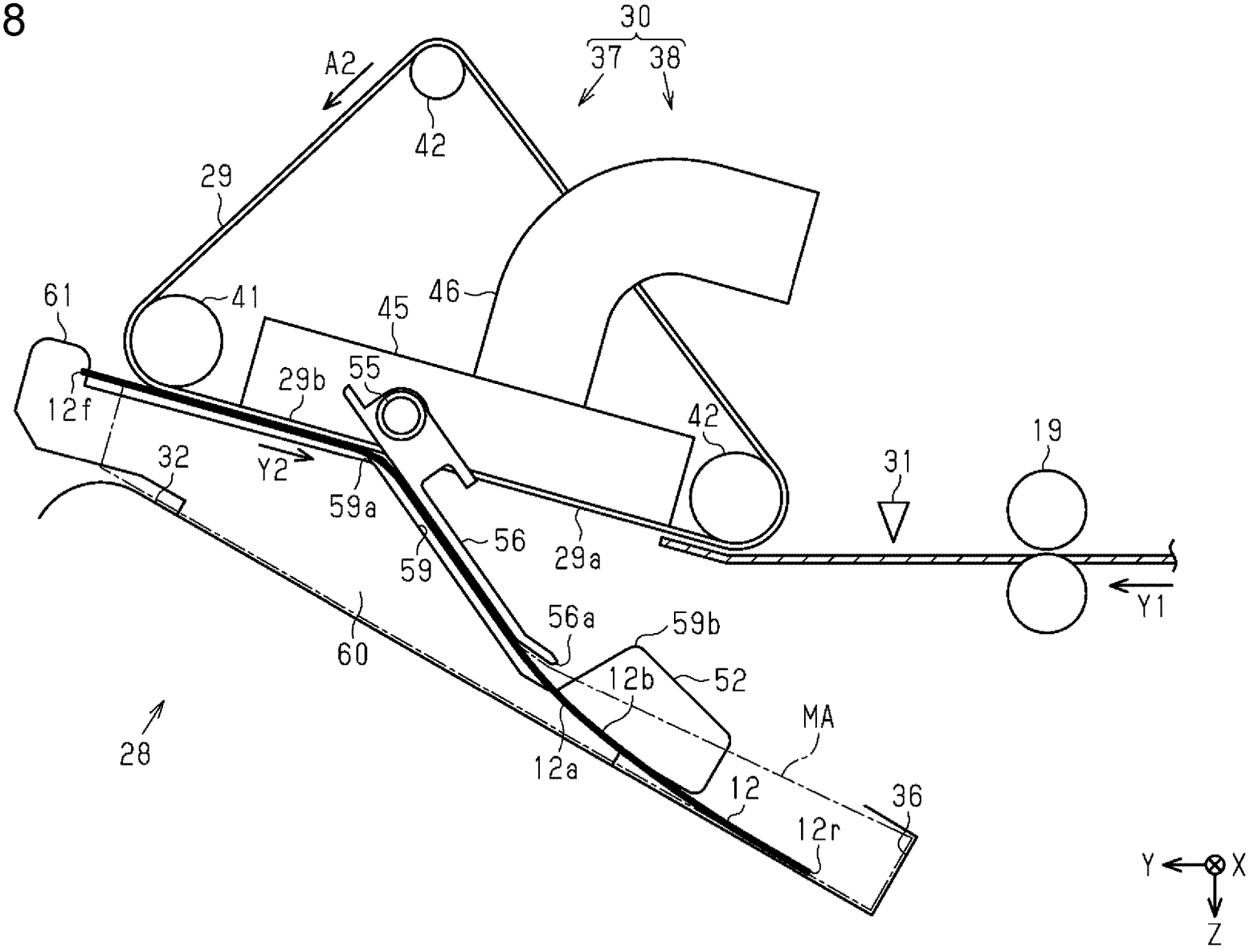
FIG. 8 is a schematic side view of the medium transporting apparatus which transports the medium in a second transport direction.

As shown in FIG. 8, when the transporting belt 29 rotates in the second rotation direction A2, the medium 12 is transported in the second transport direction Y2. The movable guide 56 positioned at the second guide position contacts the upper surface 12*b* of the medium 12 transported in the second transport direction Y2, and peels off the medium 12 from the suction surface 29*a*. The medium 12 peeled off from the suction surface 29*a* by the movable guide 56 is positioned by the rear end 12*r* abutting on the adjustment portion 36, and is stacked on the intermediate stacker 32 positioned below the transporting belt 29.

As described above, when the transporting belt 29 rotates in the second rotation direction A2 and transports the medium 12 in the second transport direction Y2, part of the medium 12 is transported while being suctioned by the transporting belt 29, so that a state in which the medium 12 and the intermediate stacker 32 are separated from each other is generated. Thus, for example, it is possible to reduce a chance that the lower surface 12*a* of the subsequent medium 12 contacts the upper surface 12*b* of the preceding medium 12 already stacked on the intermediate stacker 32.

In particular, in an ink jet printer using an aqueous ink, when liquid such as ink is made to adhere to the medium 12, resistance when the media 12 slide with each other is increased. Thus, when the subsequent medium 12 is stacked on the intermediate stacker 32, in a case in which the lower surface 12*a* of the subsequent medium 12 contacts the upper surface 12*b* of the preceding medium 12 for a long time, the rear end 12*r* of the subsequent medium 12 may not properly contact the adjustment portion 36 due to sliding resistance between the preceding medium 12 and the subsequent medium 12, and thus the subsequent medium 12 may not be properly stacked on the intermediate stacker 32.

However, by causing the transporting belt 29 to suction the medium 12, it is possible to reduce the chance that the lower surface 12*a* of the subsequent media 12 contacts the upper surface 12*b* of the preceding media 12 already stacked on the intermediate stacker 32, so that the subsequent media 12 can be properly stacked on the intermediate stacker 32.

Figure 9:
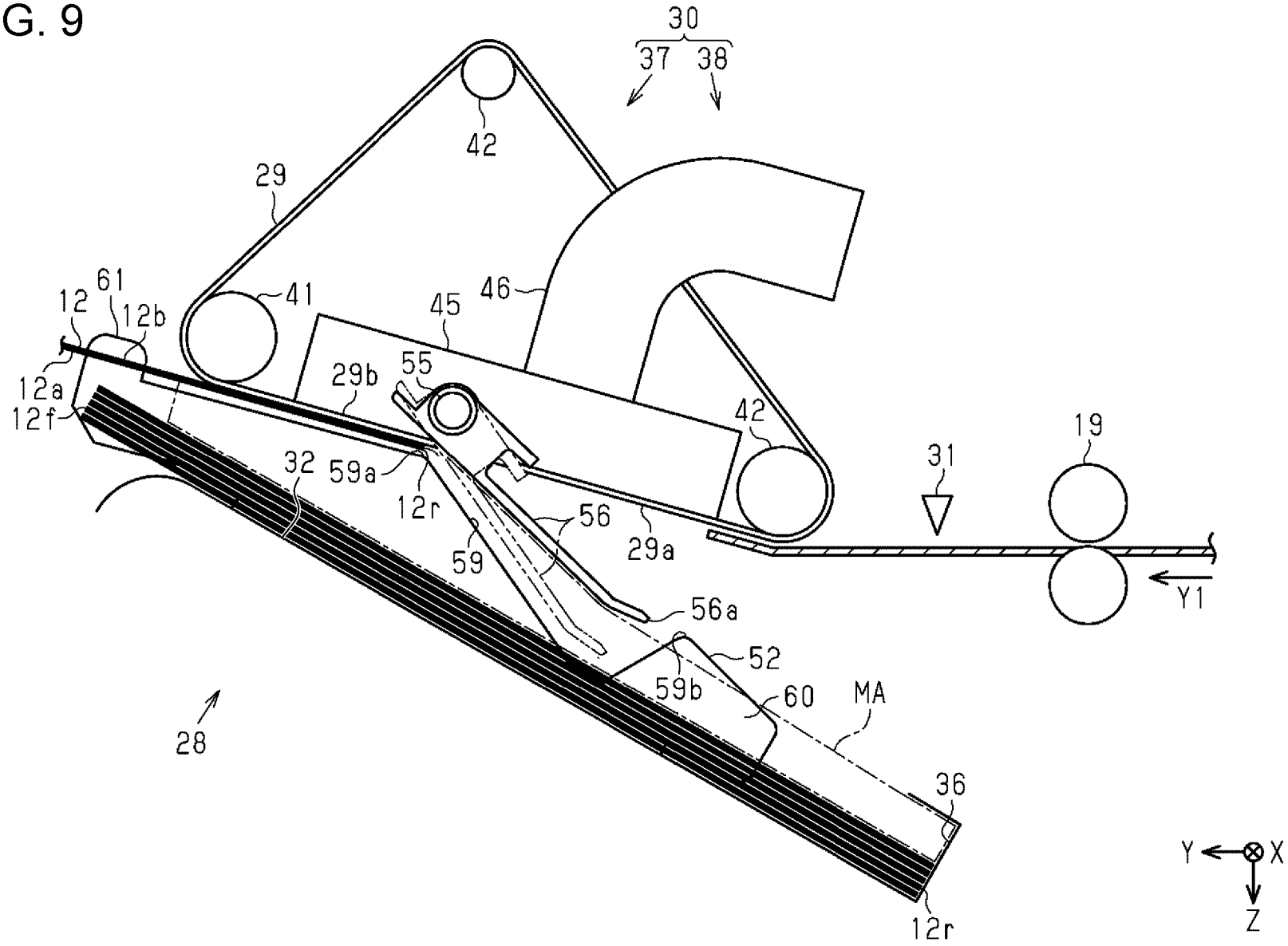
FIG. 9 is a schematic side view of the medium transporting apparatus for stacking a plurality of the media.

As shown in FIG. 9, the second guide position of the movable guide 56 is preferably varied in accordance with the number of media 12 stacked on the intermediate stacker 32. The control unit 62 may control the second guide position of the movable guide 56 so as to change in accordance with the number of the media 12 stacked on the intermediate stacker 32. When the number of the media 12 stacked on the intermediate stacker 32 is smaller than a threshold number, the control unit 62 of the present embodiment positions the movable guide 56 at the second guide position indicated by a dashed-two dotted line in FIG. 9, and when the number of the media 12 stacked on the intermediate stacker 32 is equal to or greater than the threshold number, the control unit 62 positions the movable guide 56 at the second guide position indicated by a solid line in FIG. 9. Therefore, when the number of the media 12 is large, an interval between the movable guide 56 positioned at the second guide position and the intermediate stacker 32 is larger than an interval between the movable guide 56 positioned at the second guide position and the intermediate stacker 32 when the number of the media 12 is small.

When the medium 12 is stacked on the intermediate stacker 32, an area between the medium 12 stacked on the intermediate stacker 32 and the transporting belt 29, and an area between the medium 12 stacked on the intermediate stacker 32 and the movable guide 56 become the movable area MA.

Once a predetermined number of media 12 are stacked on the intermediate stacker 32, the post-processing mechanism 33 performs post-processing on the media 12. The predetermined number subject to the post-processing is the number of sheets in a unit of copy, when the medium 12 is subject to the post-processing. The control unit 62 drives a delivery mechanism (not shown) to deliver the medium 12 stacked on the intermediate stacker 32 from the intermediate stacker 32 in the first transport direction Y1. The medium 12 delivered from the intermediate stacker 32 is stacked on the discharging stacker 34.

According to the above embodiment, it is possible to obtain the following effects.

1-1. The medium 12, which is separated from the transporting belt 29, is deformed in the movable area MA. Therefore, as the movable area MA widens, there is a risk that the medium 12 deforms largely. In this regard, the change mechanism 51 narrows the movable area MA between the transporting belt 29 and the intermediate stacker 32 when the medium 12 is transported in the second transport direction Y2, as compared with when the medium 12 is transported in the first transport direction Y1.

Accordingly, it is possible to prevent the medium 12 transported in the second transport direction Y2 from being largely deformed when separated from the transporting belt 29, and stack the medium 12 on the intermediate stacker 32 in a state in which the deformation of the medium 12 is prevented.

1-2. The movable guide 56, when positioned at the second guide position closer to the intermediate stacker 32 than the first guide position, contacts the upper surface 12*b* of the medium 12. Therefore, the medium 12 can be peeled off from the transporting belt 29 by the movable guide 56 positioned at the second guide position, and the movable area MA can be narrowed.

1-3. The second guide position of the movable guide 56 varies in accordance with the number of media 12 stacked on the intermediate stacker 32. Therefore, relationship between the movable guide 56 positioned at the second guide position and the medium 12 stacked on the intermediate stacker 32 can be appropriately maintained.

1-4. The second guide position of the movable guide 56 is controlled by the control unit 62 so as to vary in accordance with the number of media 12 stacked on the intermediate stacker 32. Therefore, it is possible to reduce a risk that the movable guide 56 contacts the medium 12 stacked on the intermediate stacker 32.

1-5. The notches 59 are formed in the pair of adjusting members 52 included in the intermediate stacker 32. Therefore, it is possible to reduce a risk that the movable guide 56 positioned at the second guide position and the adjusting member 52 interfere with each other.

1-6. The suction mechanism 38 causes the transporting belt 29 to suction the medium 12 by the draw-in method. Thus, it is possible to reduce a risk that the medium 12 is damaged as compared with a case where the medium 12 is transported by, for example, a sticky belt.

1-7. Friction resistance when the media 12 to which liquid adheres by the recording process are stacked is larger than friction resistance when the media 12 to which liquid does not adhere are stacked. Therefore, when the medium 12 after the recording process is stacked so as to slide on the medium 12 previously subjected to the recording process, there is a risk that the media 12 will not be adjusted. In this regard, the transporting mechanism 30 is positioned above the intermediate stacker 32 in the vertical direction Z and drops the media 12 from above and stacks on the intermediate stacker 32. Therefore, even when the medium 12 subjected to the recording process and has large frictional resistance is stacked on the intermediate stacker 32, the medium 12 can be stacked while being adjusted.

Second Embodiment

Next, a medium processing apparatus, a post-processing apparatus, and a medium transporting apparatus according to a second embodiment will be described with reference to the drawings. In addition, in the second embodiment, a configuration of a change mechanism is different from that of the first embodiment. Since other respects are substantially the same as those of the first embodiment, the same reference numerals will be used for the same components, and redundant descriptions thereof will be omitted.

Figure 10:
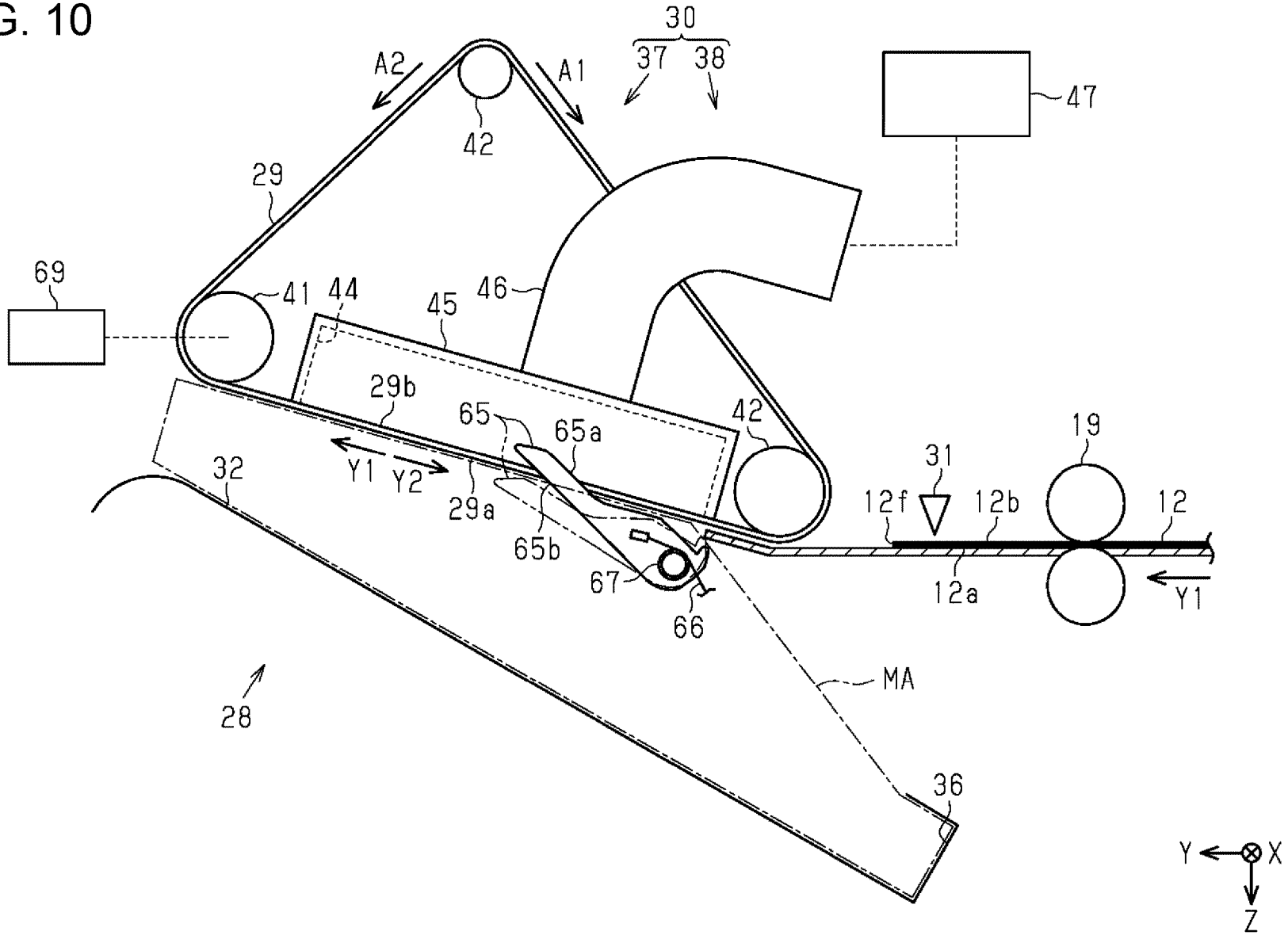
FIG. 10 is a schematic side view of a medium transporting apparatus according to a second embodiment.

As shown in FIG. 10, the post-processing apparatus 14 includes the medium transporting apparatus 28. The medium transporting apparatus 28 includes a separation flap 65 that peels off the medium 12 transported in the second transport direction Y2 from the transporting belt 29, and a biasing member 66 such as a torsion spring that biases the separation flap 65, for example. The post-processing apparatus 14 may include a plurality of the separation flaps 65 which are arranged at a distance from one another in the width direction X. The separation flap 65 has a flap upper surface 65*a* and a flap lower surface 65*b*.

Among the plurality of separation flaps 65, the separation flap 65 placed between the pair of transporting belts 29 operates to separate the medium 12 from the transporting belt 29 in common to all the transported media 12. On the other hand, the separation flap 65, which is not placed between the pair of transporting belt 29 among the plurality of separation flaps 65, operates such that at least the pair of separation flaps 65 contact a side of a side end of the medium 12 to separate the medium 12 from the transporting belt 29. In this way, even when the media 12 of different sizes are transported, it is possible to appropriately separate from the transporting belt 29. Therefore, it is preferable that a position of the separation flap 65 not placed between the pair of transporting belts 29 be determined in accordance with a plurality of regular sizes of the media 12 which are supposed to be transported.

The separation flap 65 swings around a flap shaft 67 and is provided so as to be changeable in posture. The separation flap 65 is movable between a first flap position, indicated by a solid line in FIG. 10, and a second flap position, indicated by a dashed-two dotted line in FIG. 10. The biasing member 66 biases the separation flap 65 toward the first flap position. When the separation flap 65 is positioned at the first flap position, the flap upper surface 65*a* and the flap lower surface 65*b* intersect with the suction surface 29*a* of the transporting belt 29 when viewed from the width direction X. When the separation flap 65 is positioned at the first flap position, an angle formed by the flap upper surface 65*a* and the suction surface 29*a* is an acute angle, and an angle formed by the flap lower surface 65*b* and the suction surface 29*a* is an obtuse angle.

The change mechanism 69 included in the medium transporting apparatus 28 of the present embodiment rotates the transporting mechanism 30 and the flap shaft 67 around the drive pulley 41 positioned on a most downstream side in the first transport direction Y1, among the drive pulley 41 and the driven pulleys 42. In other words, the change mechanism 69 moves the transporting belt 29 relative to the intermediate stacker 32, thereby changing a size of the movable area MA that is an area sandwiched between the transporting belt 29 and the intermediate stacker 32.

Figure 13:
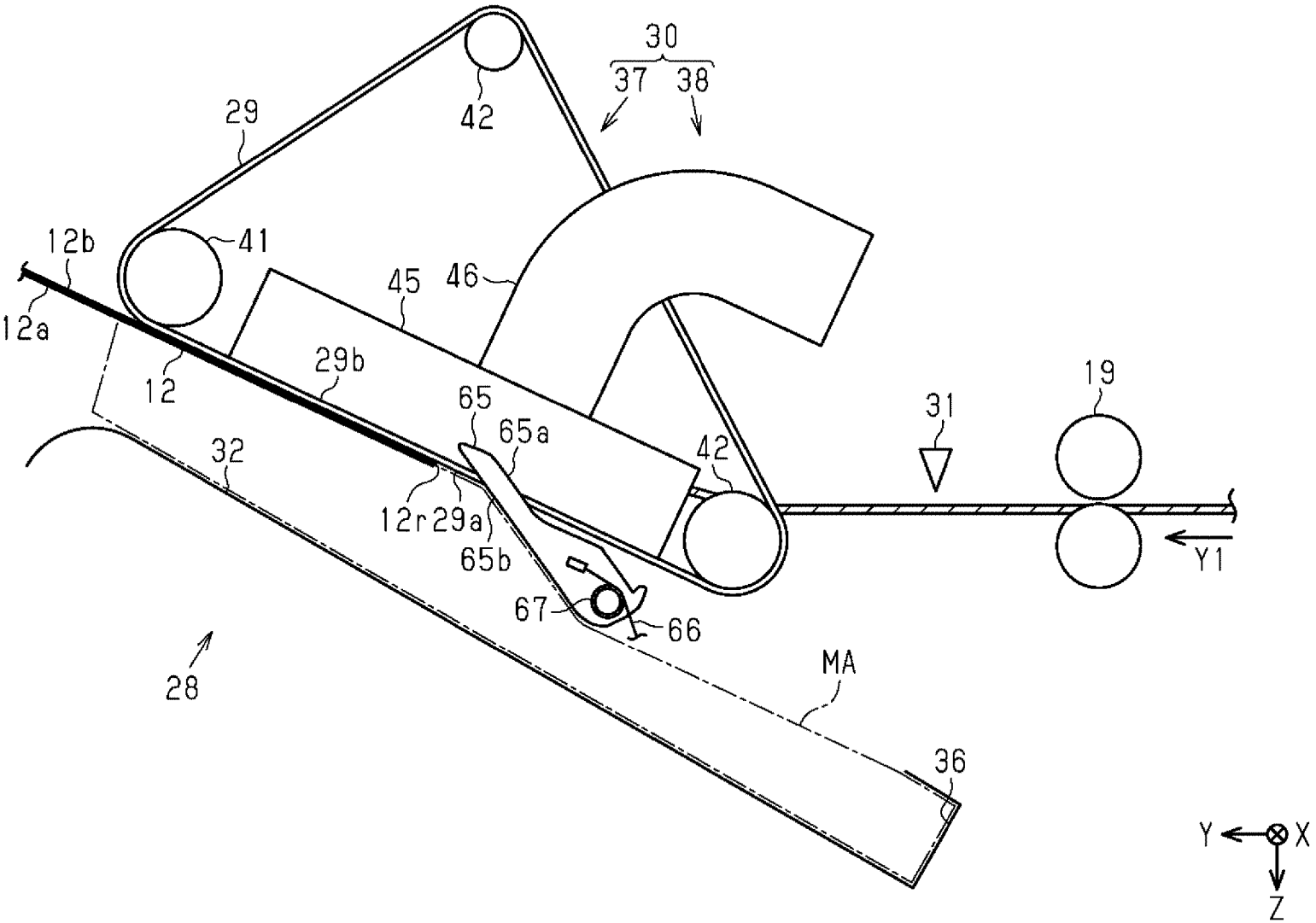
FIG. 13 is a schematic side view of the medium transporting apparatus when the rotation direction of the transporting belt is switched.

The transporting belt 29 is provided so as to be movable between a first belt position shown in FIG. 10 and a second belt position shown in FIG. 13 which is closer to the intermediate stacker 32 than the first belt position. The size of the movable area MA on a downstream side in the second transport direction Y2 when the transporting mechanism 30 is positioned at the second belt position is narrower than that when the transporting mechanism 30 is positioned at the first belt position.

Next, an operation of the medium processing apparatus 11 will be described.

As shown in FIG. 10, when the medium 12 is transported in the first transport direction Y1 by the transport roller pair 19, the control unit 62 drives the fan 47 in a state in which the transporting belt 29 is positioned at the first belt position, and rotates the transporting belt 29 in the first rotation direction A1 by normally rotating and driving the belt motor 40.

Figure 11:
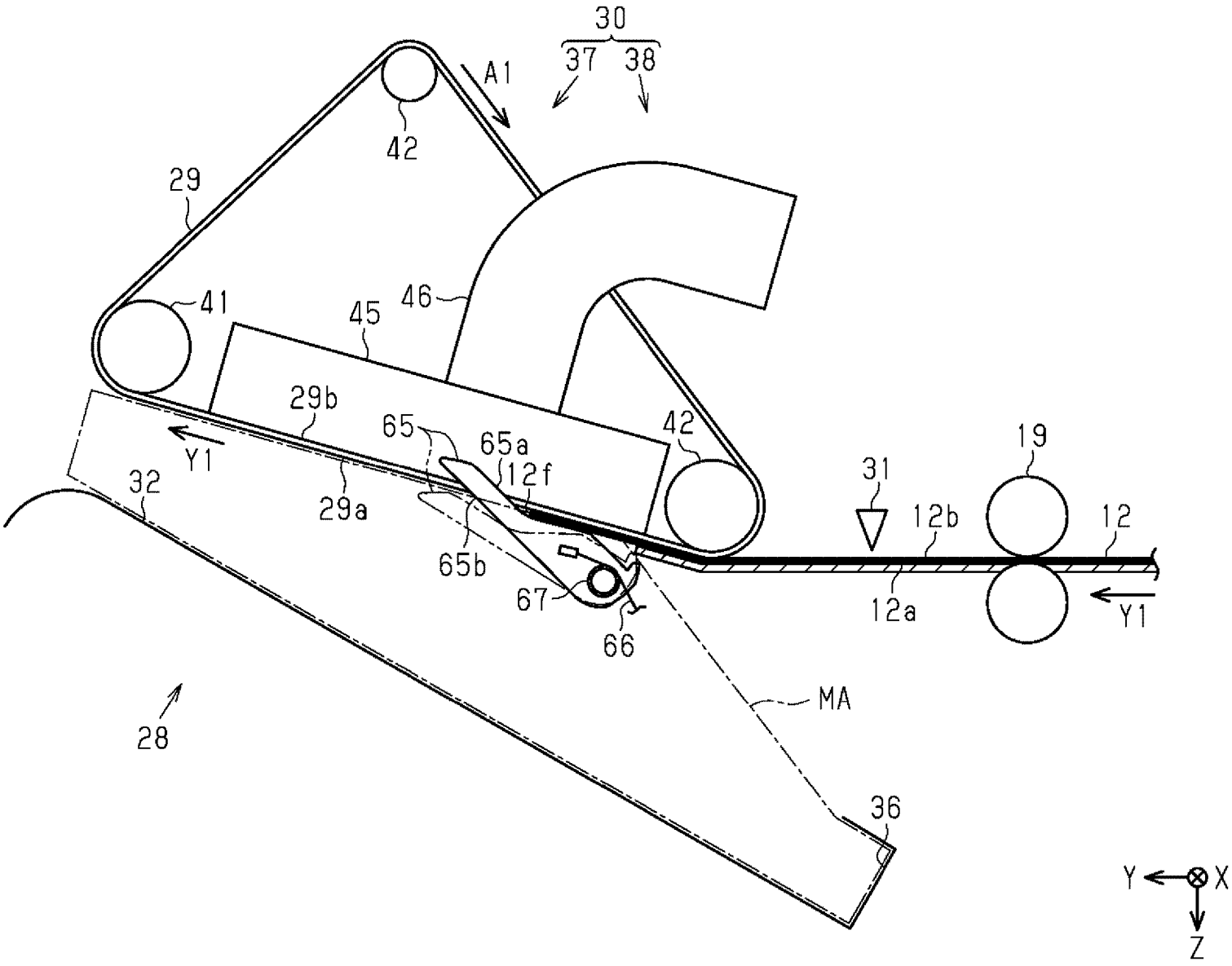
FIG. 11 is a schematic side view of the medium transporting apparatus in which the transporting belt suctions a medium.

As shown in FIG. 11, when the medium 12 is transported to the transporting belt 29, the suction mechanism 38 suctions the upper surface 12*b* of the medium 12. The transporting belt 29 which rotates in the first rotation direction A1 transports the suctioned medium 12 in the first transport direction Y1. When the media 12 is transported to the separation flap 65, a front end 12*f* of the media 12 contacts the flap upper surface 65*a* and pushes the separation flap 65. Thus, the separation flap 65 rotates against biasing force of the biasing member 66, and moves to the second flap position indicated by a dashed-two dotted line in FIG. 11.

Figure 12:
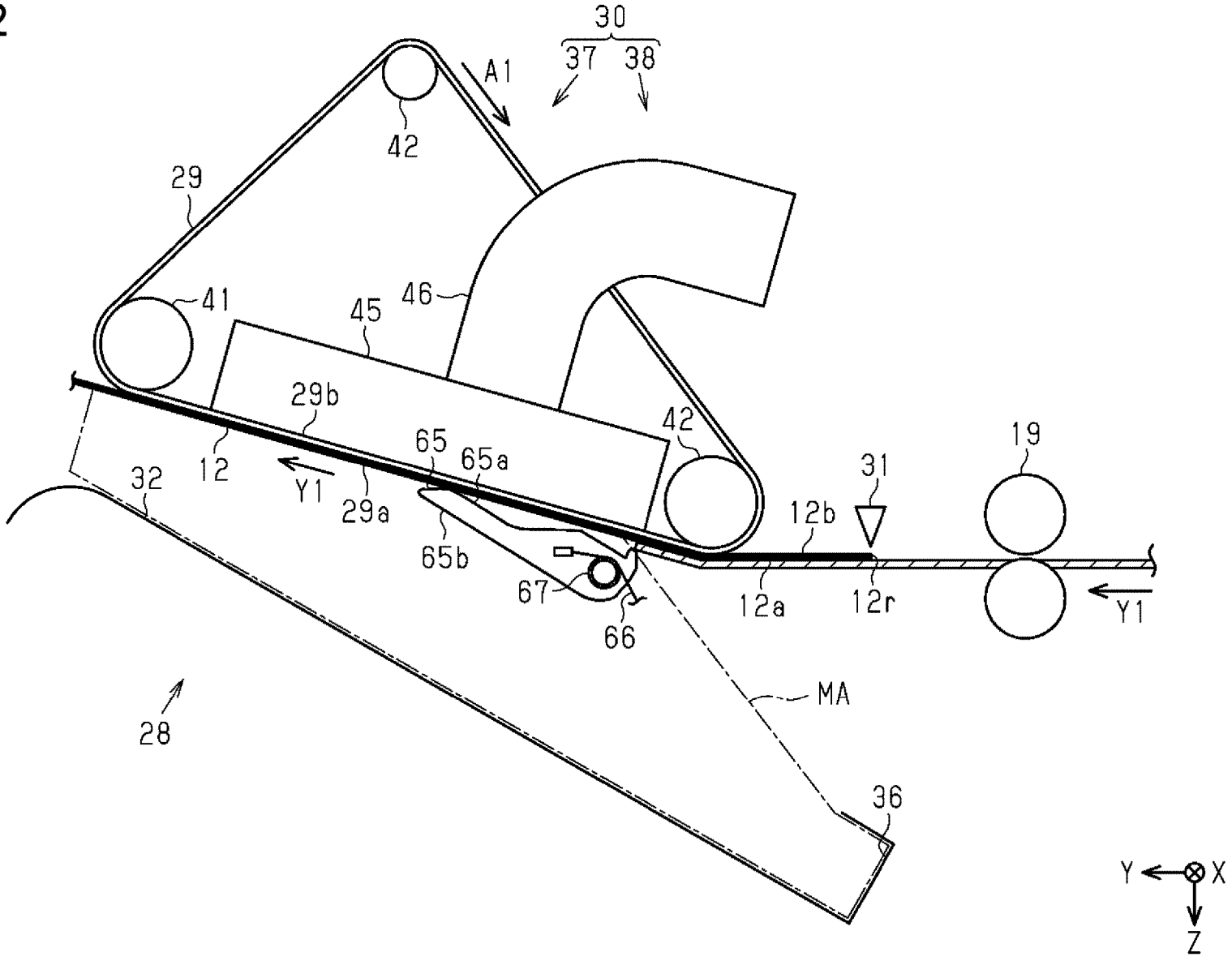
FIG. 12 is a schematic side view of the medium transporting apparatus which transports the suctioned medium in the first transport direction.

As shown in FIG. 12, at least part of the flap upper surface 65*a* contacts the lower surface 12*a* of the medium 12 when the medium 12 transported in the first transport direction Y1 passes through the separation flap 65. The medium 12 is pressed against the transporting belt 29 by the separation flap 65 biased by the biasing member 66, and is transported in a state of being pinched between the separation flap 65 and the transporting belt 29.

When the detection unit 31 detects the rear end 12*r* of the medium 12, the control unit 62 reversely rotates and drives the belt motor 40 after a lapse of a predetermined time period. In other words, when the rear end 12*r* is detected in a state in which the belt motor 40 is normally rotated and driven, the control unit 62 continues to normally rotate and drive the belt motor 40 for a predetermined time period and rotates the transporting belt 29 in the first rotation direction A1. After the lapse of the predetermined time period since the rear end 12*r* is detected, the control unit 62 temporarily stops driving of the belt motor 40, and then reversely rotates and drives the belt motor 40 to rotate the transporting belt 29 in the second rotation direction A2.

The predetermined time period is time required for the rear end 12*r* of the medium 12 to pass through the separation flap 65. The predetermined time period is substantially equal to a quotient obtained by dividing a distance along the transport path 17 from the detection unit 31 to a tip of the separation flap 65 by a speed at which the medium 12 is transported.

As shown in FIG. 13, when the rotation direction of the transporting belt 29 is changed from the first rotation direction A1 to the second rotation direction A2 after the lapse of the predetermined time period, the medium 12 is temporarily stopped in a state in which the rear end 12*r* is positioned on a downstream side of the separation flap 65 in the first transport direction Y1. When the media 12 separates from the separation flap 65, the separation flap 65 returns to the first flap position due to the biasing force of the biasing member 66. In other words, the separation flap 65 is positioned at the first flap position when the rotation direction of the transporting belt 29 is switched from the first rotation direction A1 to the second rotation direction A2.

The control unit 62 drives the change mechanism 69 in a state in which the rotation of the transporting belt 29 is temporarily stopped, moves the transporting belt 29 to the second belt position, and rotates the transporting belt 29 positioned at the second belt position in the second rotation direction A2. In other words, when the medium 12 is transported in the first transport direction Y1, the change mechanism 69 positions the transporting belt 29 at the first belt position, and when the medium 12 is transported in the second transport direction Y2, the change mechanism 69 brings the transporting belt 29 closer to the intermediate stacker 32 and positions the transporting belt 29 at the second belt position.

Figure 14:
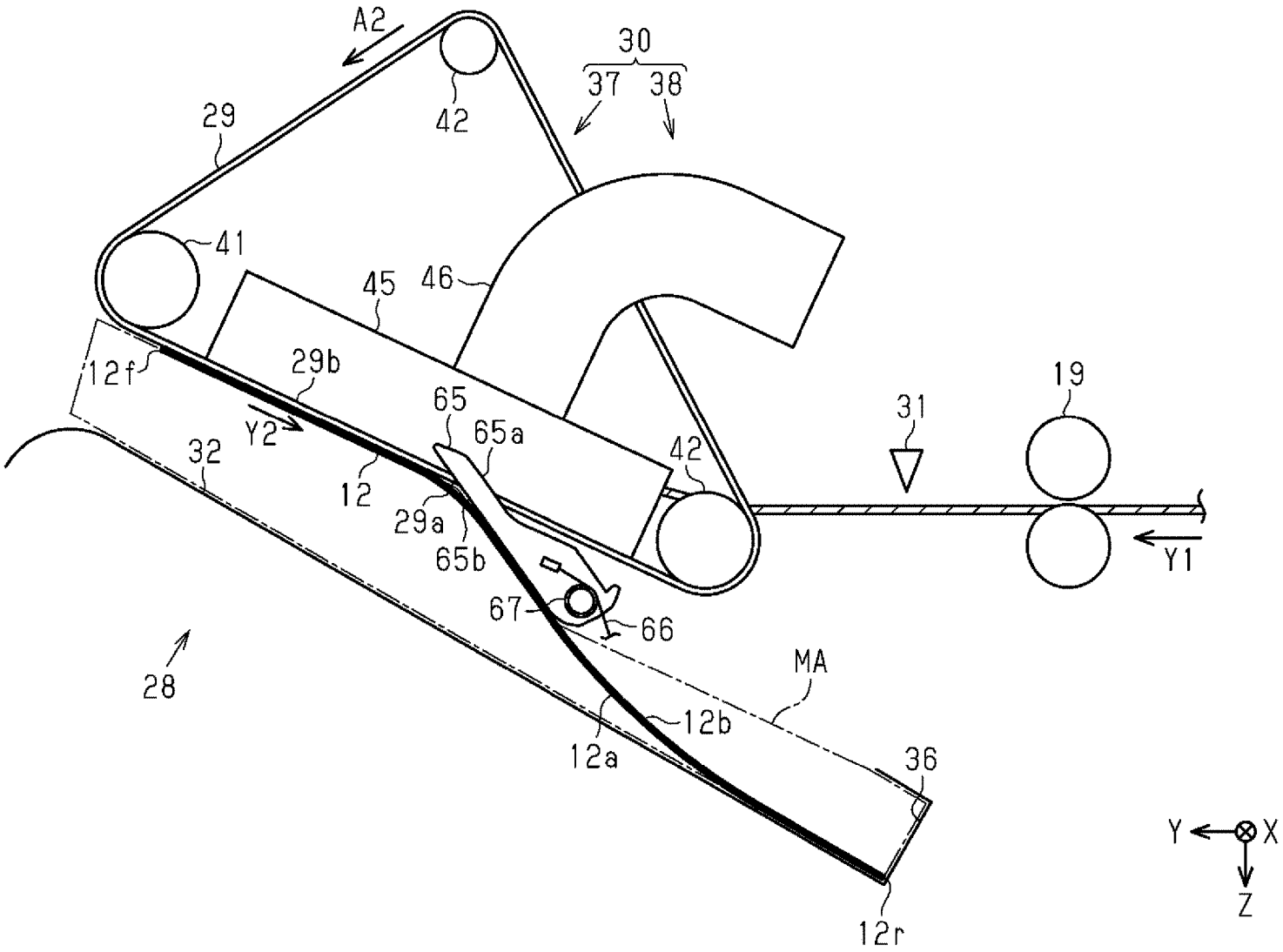
FIG. 14 is a schematic side view of the medium transporting apparatus which transports the medium in the second transport direction.

As shown in FIG. 14, when the transporting belt 29 rotates in the second rotation direction A2, the medium 12 is transported in the second transport direction Y2. At this time, the separation flap 65 is positioned at the first flap position, and at least part of the flap lower surface 65*b* contacts the upper surface 12*b* of the medium 12 transported in the second transport direction Y2, and peels off the medium 12 from the suction surface 29*a*. The medium 12 peeled off from the suction surface 29*a* by the separation flap 65 is positioned by the rear end 12*r* abutting on the adjustment portion 36, and is stacked on the intermediate stacker 32 positioned below the transporting belt 29. When a predetermined number of the media 12 are stacked on the intermediate stacker 32, the post-processing mechanism 33 performs post-processing on the medium 12. The predetermined number subject to the post-processing is the number of sheets in a unit of copy, when the medium 12 is subject to the post-processing.

According to the second embodiment, in addition to the effects of the first embodiment, it is possible to obtain the following effects.

2-1. When the medium 12 is transported in the first transport direction Y1, the change mechanism 69 positions the transporting belt 29 at the first belt position, and when the medium 12 is transported in the second transport direction Y2, the change mechanism 69 positions the transporting belt 29 at the second belt position that is closer to the intermediate stacker 32 than the first belt position. Therefore, the movable area MA can be narrowed by the transporting belt 29, and the medium 12 can be stacked on the intermediate stacker 32 in a state in which the transporting belt 29 is close to the intermediate stacker 32, so that the medium 12 can be stacked quickly.

Third Embodiment

Next, a medium processing apparatus, a post-processing apparatus, and a medium transporting apparatus according to a third embodiment will be described with reference to the drawings. In addition, in the third embodiment, a configuration of a change mechanism is different from that of the first embodiment and that of the second embodiment. Since other respects are substantially the same as those of the first embodiment and the second embodiment, the same reference numerals will be used for the same components, and redundant descriptions thereof will be omitted.

Figure 15:
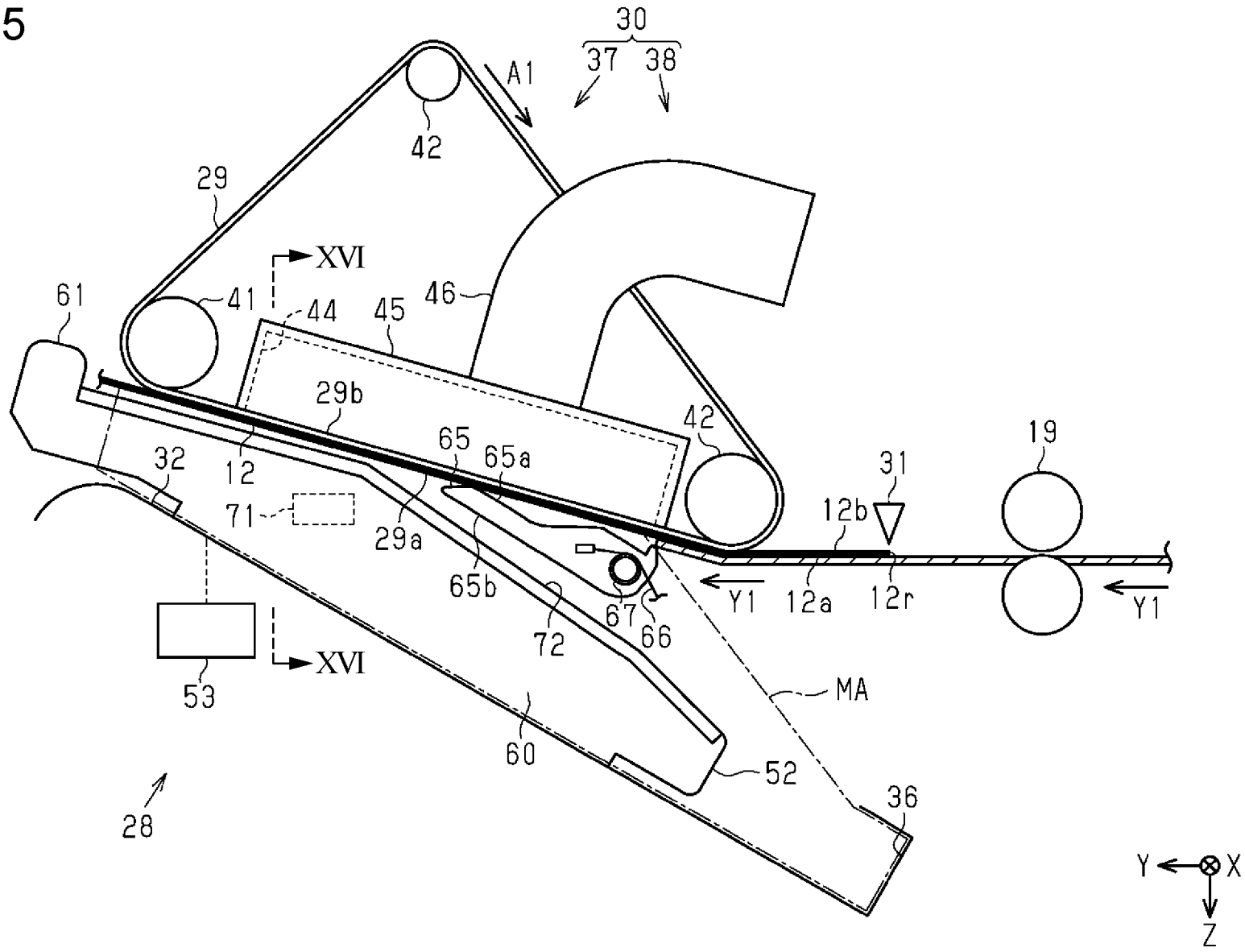
FIG. 15 is a schematic side view of a medium transporting apparatus according to a third embodiment.

As shown in FIG. 15, the post-processing apparatus 14 includes an air blowing unit 71 that blows the air toward the medium 12. Each of the pair of adjusting members 52 has an area guide 72 which is an example of a second guide surface provided at a position closer to the transporting belt 29 than the adjustment surface 60. The area guide 72 is capable of facing the lower surface 12*a* of the medium 12 which is suctioned and transported by the transporting belt 29.

Figure 16:
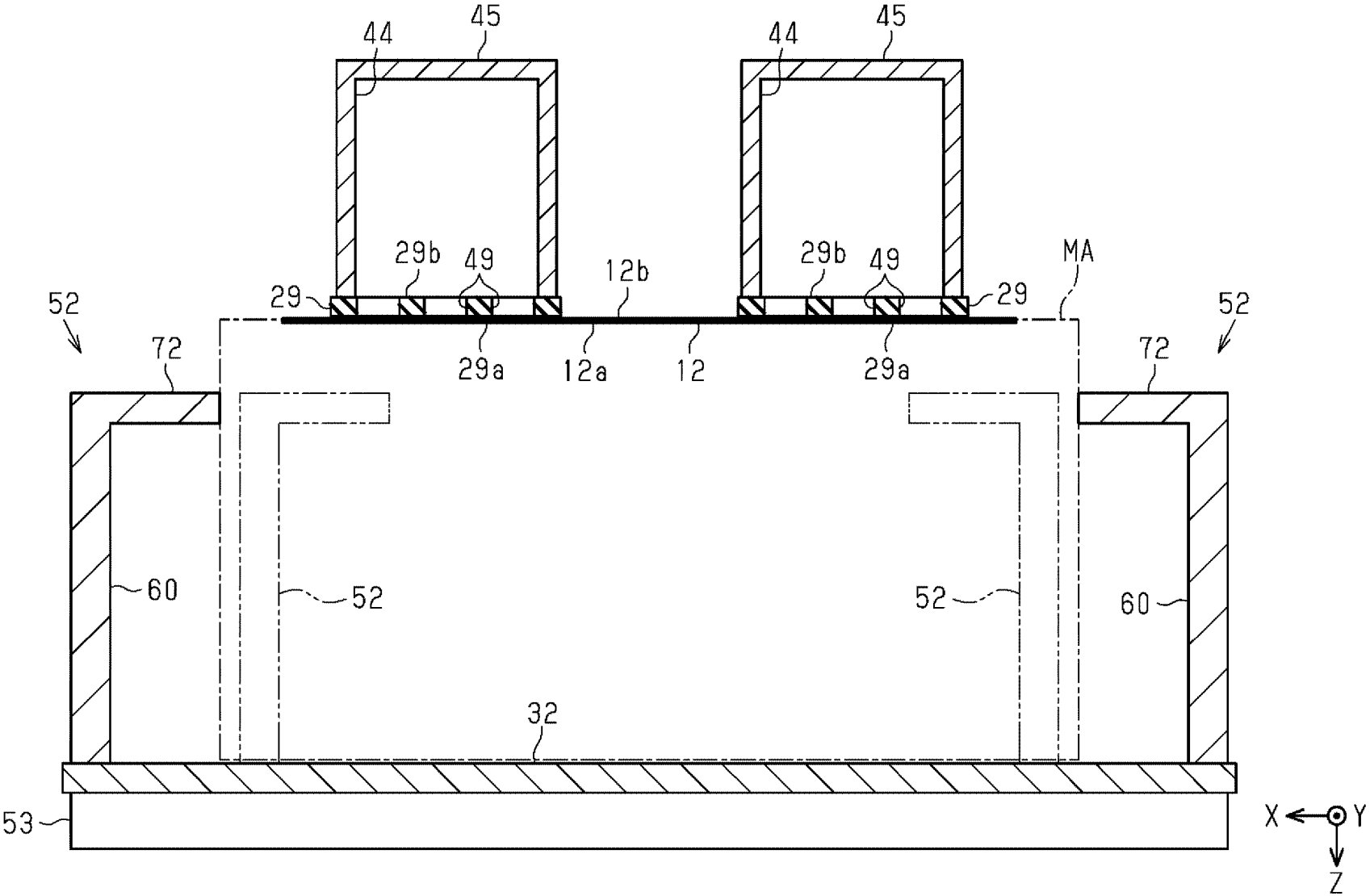
FIG. 16 is a schematic end view taken along a line XVI-XVI in FIG. 15.

As shown in FIG. 16, the area guide 72 is formed in an eaves shape so as to extend from a position above the adjustment surface 60 in the adjusting member 52 toward the other adjusting member 52. Therefore, in the width direction X, an interval between a pair of the area guides 72 is narrower than an interval between a pair of the adjustment surfaces 60.

In the medium transporting apparatus 28 of the present embodiment, the moving mechanism 53, which is an example of a change mechanism, moves the adjusting member 52 in the width direction X, thereby changing the size of the movable area MA. The moving mechanism 53 moves the pair of adjusting members 52 to a retracted position indicated by a solid line in FIG. 16 and an adjusted position indicated by a dashed-two dotted line in FIG. 16. In the width direction X, an interval between the pair of adjusting members 52 positioned at the adjusted position is narrower than an interval between the pair of adjusting members 52 positioned at the retracted position.

In the width direction X, an interval between the pair of adjustment surfaces 60 when the pair of adjusting members 52 is positioned at the adjusted position is narrower than an interval between the pair of adjustment surfaces 60 when the pair of adjusting members 52 is positioned at the retracted position, and is substantially the same as a width of the medium 12. An interval in the width direction X between the area guides 72 when the pair of adjusting members 52 is positioned at the adjusted position is narrower than the width of the medium 12. An interval in the width direction X between the pair of the area guides 72 when the pair of adjusting members 52 is positioned at the retracted position is wider than the width of the medium 12.

Next, an operation of the medium processing apparatus 11 will be described.

As shown in FIG. 15 and FIG. 16, when the transporting belt 29 rotates in the first rotation direction A1 and transports the medium 12 in the first transport direction Y1, the moving mechanism 53 positions the pair of adjusting members 52 at the retracted position. At this time, the area between the transporting belt 29 and the intermediate stacker 32 becomes the movable area MA.

When the detection unit 31 detects the rear end 12*r* of the medium 12, and after a lapse of a predetermined time since the rear end 12*r* is detected, the control unit 62 temporarily stops driving of the belt motor 40, and then reversely rotates and drives the belt motor 40 to rotate the transporting belt 29 in the second rotation direction A2.

Figure 17:
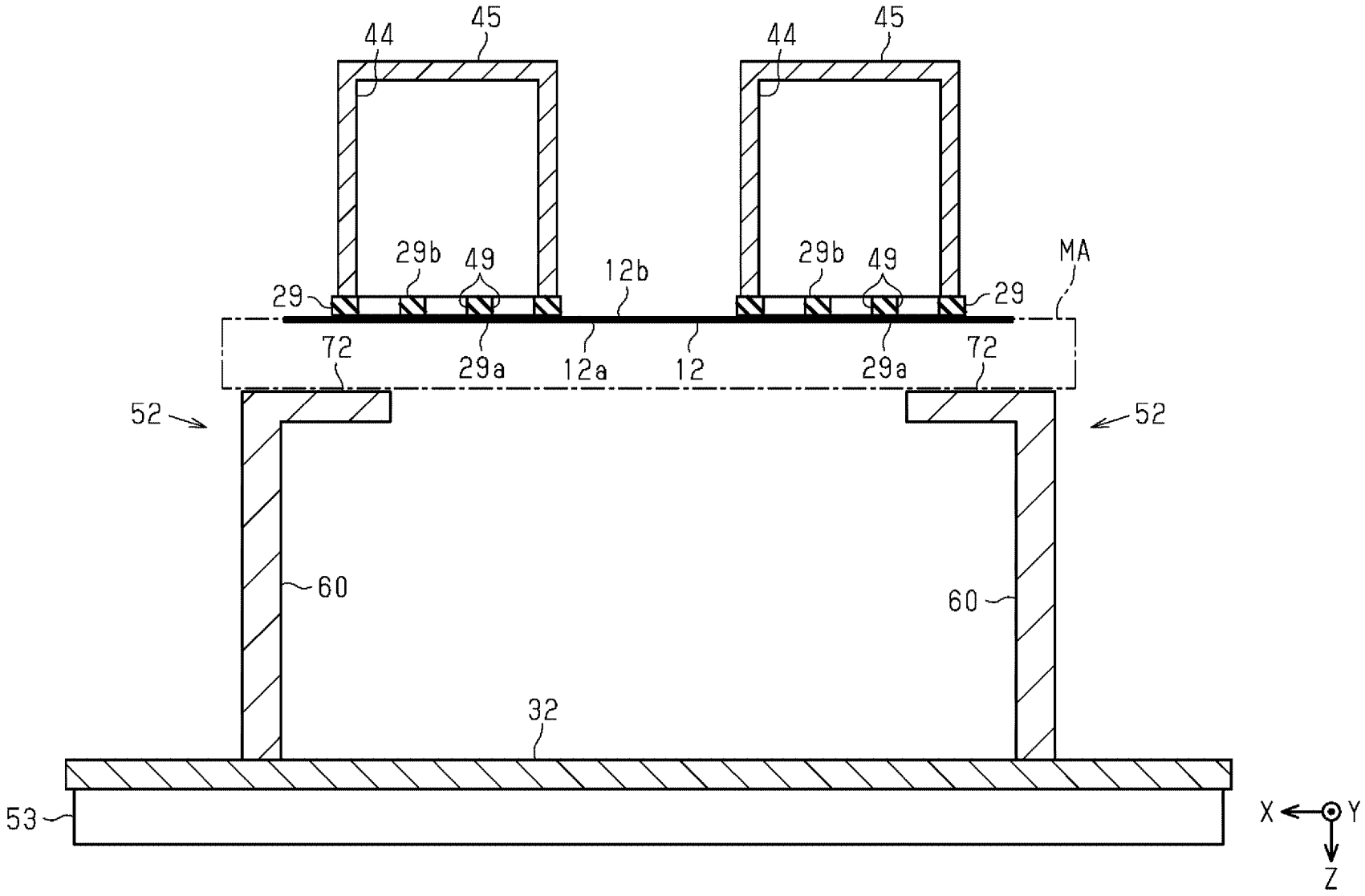
FIG. 17 is a schematic end view showing a state in which an adjusting member is positioned at an adjusted position.

As shown in FIG. 17, the moving mechanism 53 positions the adjusting member 52 at the adjusted position in a state in which the rotation of the transporting belt 29 is temporarily stopped. Thus, the lower surface 12*a* of the medium 12 and the area guide 72 face each other, and an area between the transporting belt 29 and the area guide 72 becomes the movable area MA. When the transporting belt 29 rotates in the second rotation direction A2 and transports the medium 12 in the second transport direction Y2, the moving mechanism 53 positions the pair of adjusting members 52 at the adjusted position.

Figure 18:
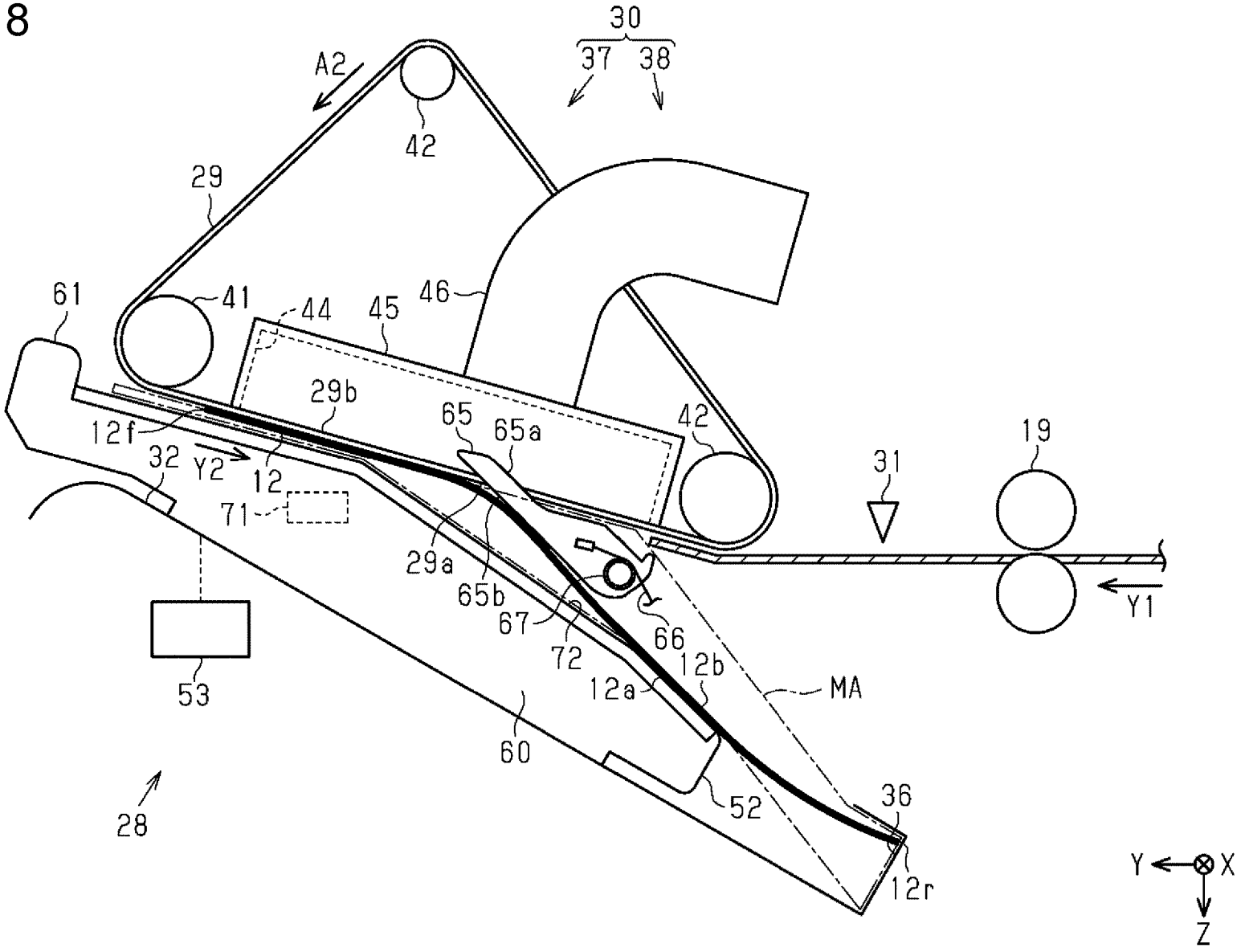
FIG. 18 is a schematic side view of the medium transporting apparatus which transports the medium in the second transport direction.

As shown in FIG. 18, when the transporting belt 29 rotates in the second rotation direction A2, the medium 12 is transported in the second transport direction Y2 and is peeled off from the transporting belt 29 by the separation flap 65. The area guide 72 contacts the lower surface 12*a* of the medium 12 peeled off from the transporting belt 29 and guides the medium 12.

When the transporting belt 29 transports the medium 12 in the second transport direction Y2, the air blowing unit 71 blows the air toward the lower surface 12*a* of the medium 12. The medium 12 blown with wind from below is pressed against the transporting belt 29, a guide member (not shown), and the like which are positioned on an upper side, by a wind pressure, and is transported in a state in which deformation such as curl is suppressed. When the rear end 12*r* of a medium 12 abuts on the adjustment portion 36 and the medium 12 is positioned, the control unit 62 stops the driving of the belt motor 40 and stops driving of the air blowing unit 71.

Figure 19:
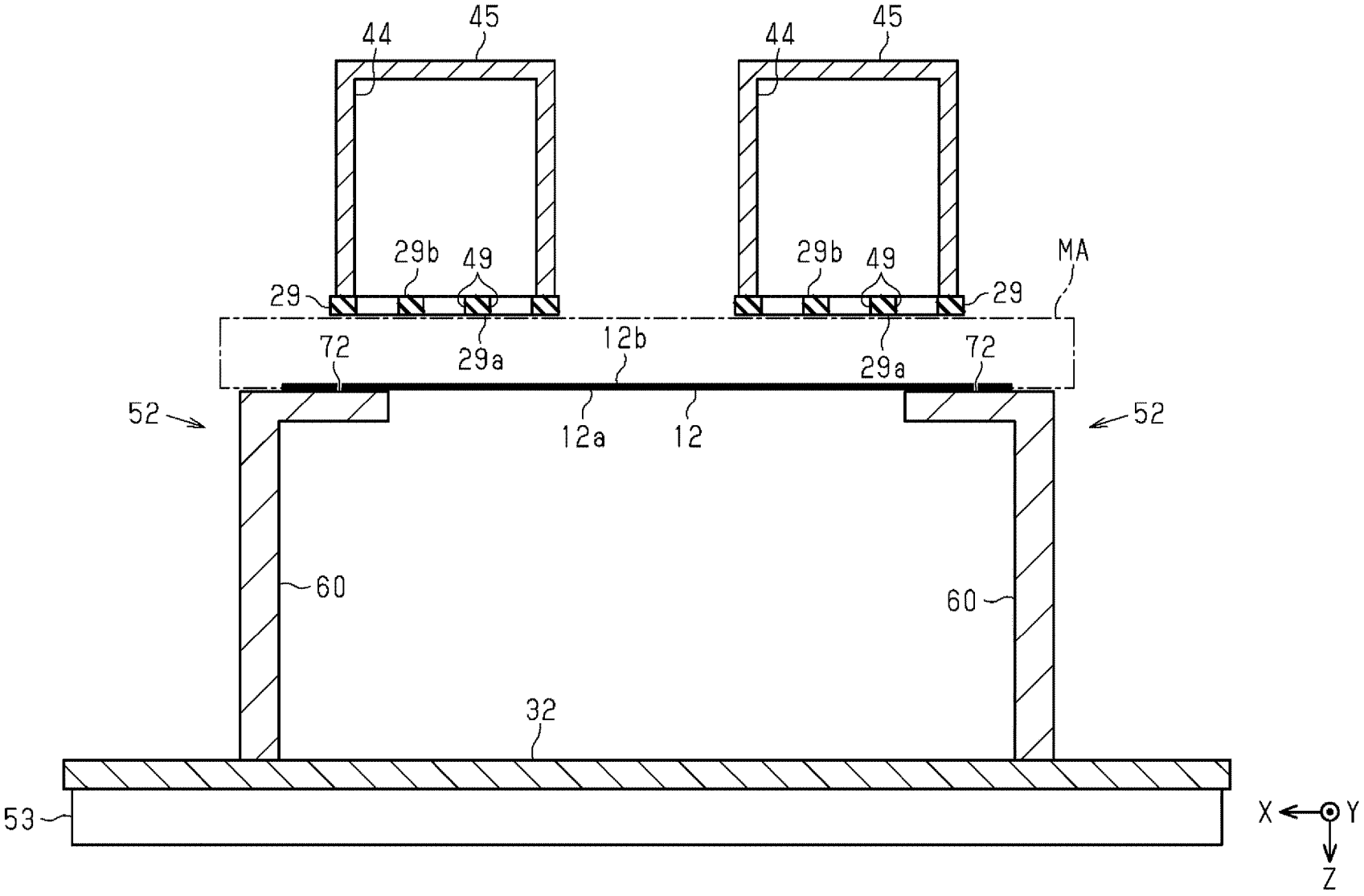
FIG. 19 is a schematic end view showing a state in which the adjusting member is positioned at the adjusted position.

As shown in FIG. 19, the medium 12 peeled off from the transporting belt 29 is supported by the area guide 72.

Figure 20:
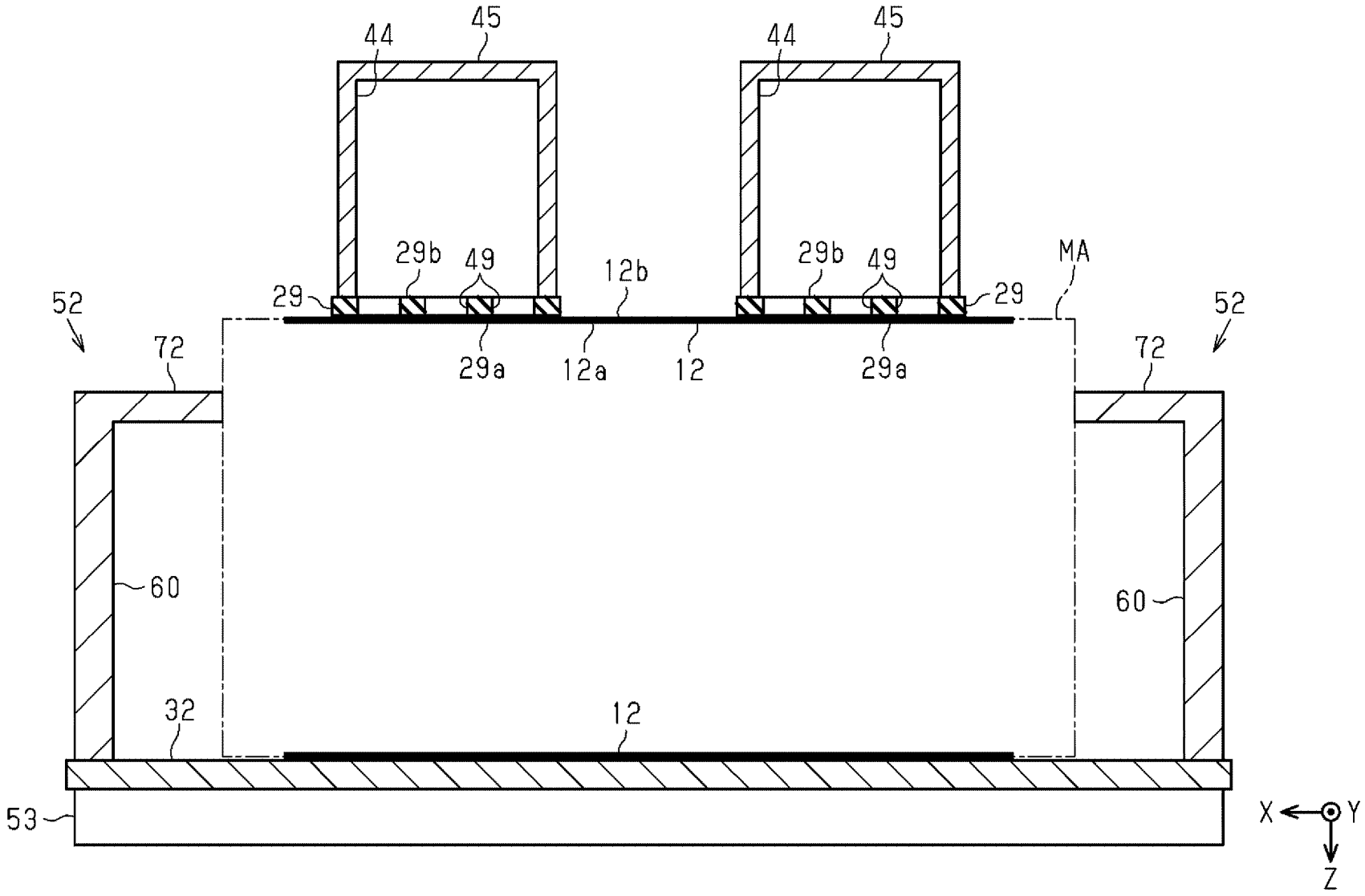
FIG. 20 is a schematic end view showing a state in which the adjusting member is positioned at a retracted position.

As shown in FIG. 20, when the next medium 12 is transported by the transport roller pair 19 and the detection unit 31 detects the front end 12*f* of the next medium 12, the control unit 62 normally rotates and drives the belt motor 40 to rotate the transporting belt 29 in the first rotation direction A1 and also positions the pair of adjusting members 52 at the retracted position. Thus, the preceding medium 12 supported by the area guide 72 is dropped from the area guide 72 and stacked on the intermediate stacker 32.

Figure 21:
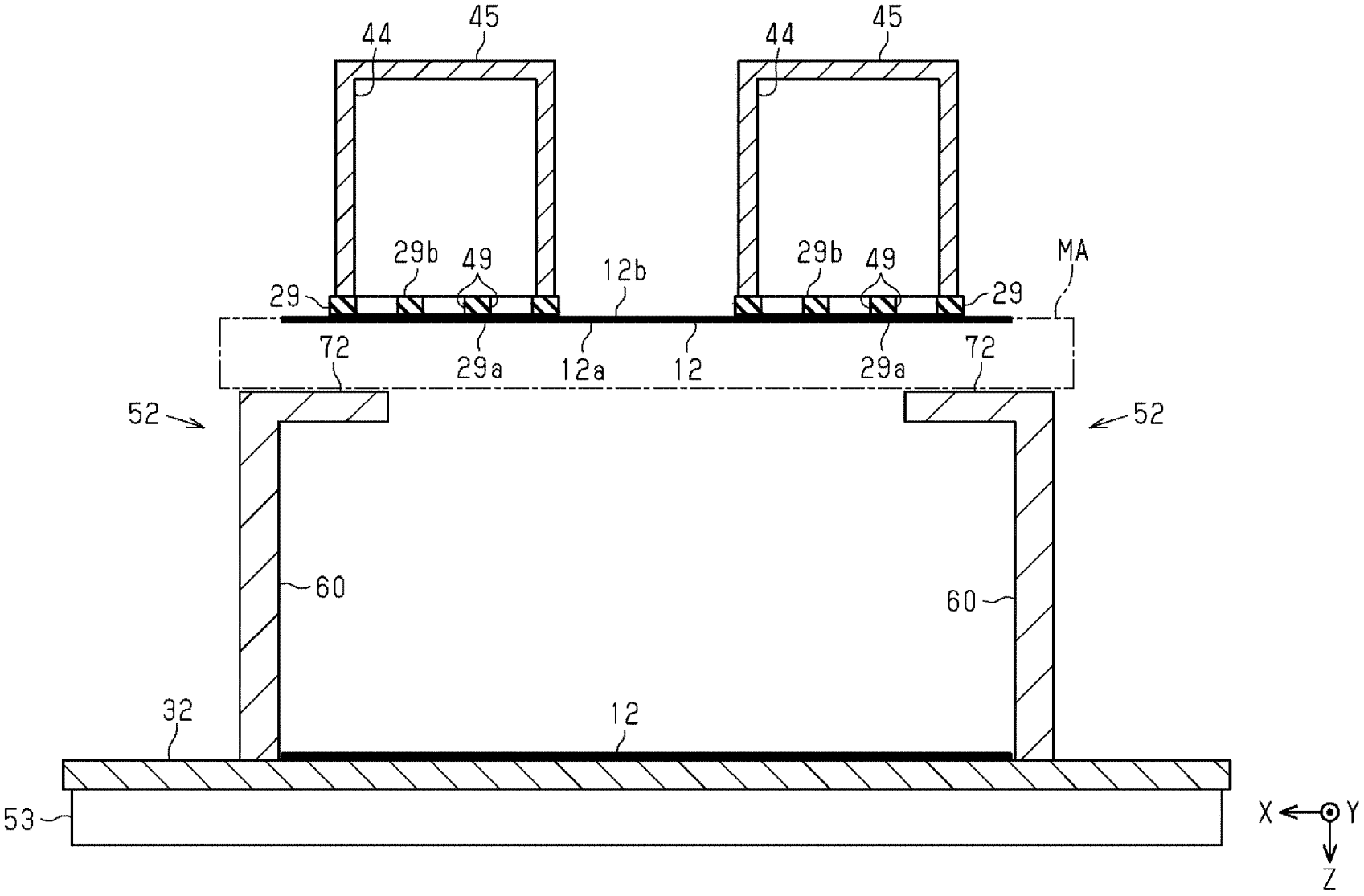
FIG. 21 is a schematic end view showing a state in which the adjusting member is positioned at the adjusted position.

As shown in FIG. 21, when the detection unit 31 detects the rear end 12*r* of the subsequent medium 12, the control unit 62 drives the moving mechanism 53 to move the pair of adjusting members 52 to the adjusted position. The adjusting member 52 adjusts the medium 12 stacked on the intermediate stacker 32 in the width direction X. The control unit 62 temporarily stops the driving of the belt motor 40 after a lapse of a predetermined time since the rear end 12*r* is detected, and then reversely rotates and drives the belt motor 40 to rotate the transporting belt 29 in the second rotation direction A2, and stacks the subsequent medium 12 on the intermediate stacker 32 in the same manner as in the case of the preceding medium 12. When a predetermined number of the media 12 are stacked on the intermediate stacker 32, the post-processing mechanism 33 performs post-processing on the medium 12. The predetermined number subject to the post-processing is the number of sheets in a unit of copy, when the medium 12 is subject to the post-processing.

According to the third embodiment, in addition to the effects of the first and the second embodiments, it is possible to obtain the following effects.

3-1. In the width direction X, an interval between the pair of area guides 72 is narrower than an interval between the pair of adjustment surfaces 60. Therefore, when the next medium 12 is transported in the second transport direction Y2 in a state in which the adjustment surface 60 contacts an end of the medium 12 and the adjusting member 52 adjusts the medium 12, the next medium 12 is guided by the area guide 72. Since the area guide 72 is positioned closer to the transporting belt 29 side than the adjustment surface 60, the movable area MA of the medium 12 can be narrowed by the area guide 72.

3-2. The air blowing unit 71 which blows the air toward the lower surface 12*a* of the medium 12 is included. Therefore, it is possible to stabilize behavior of the medium 12 that is separated from the transporting belt 29.

Fourth Embodiment

Next, a medium processing apparatus, a post-processing apparatus, and a medium transporting apparatus according to a fourth embodiment will be described with reference to the drawings. In addition, in the fourth embodiment, a configuration of a change mechanism is different from those of the first embodiment through the third embodiment. Since other respects are substantially the same as those of the first embodiment through the third embodiment, the same reference numerals will be used for the same components, and redundant descriptions thereof will be omitted.

Figure 22:
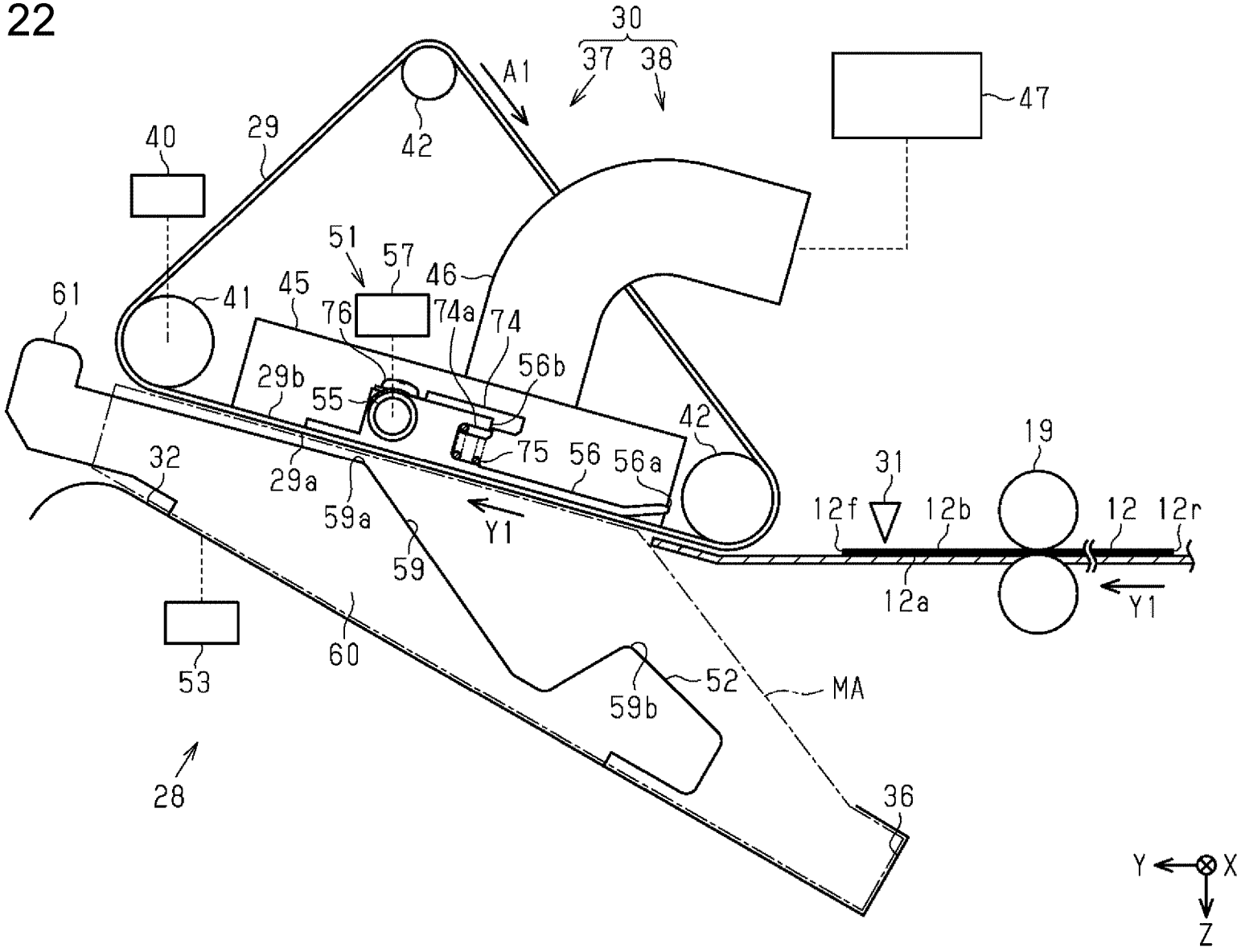
FIG. 22 is a schematic side view of a medium transporting apparatus according to a fourth embodiment.

As shown in FIG. 22, the change mechanism 51 includes the movable guide 56 which is rotatable around the guide shaft 55, and the guide motor 57 which rotates the guide shaft 55. The movable guide 56 inserts the guide shaft 55 therethrough and is provided so as to be rotated with respect to the guide shaft 55.

The change mechanism 51 includes a moving member 74 movable with the movable guide 56, and a coil spring 75 provided between the movable guide 56 and the moving member 74. The moving member 74 is fixed to the guide shaft 55 by a screw 76. The moving member 74 rotates integrally with the guide shaft 55 around the guide shaft 55. The movable guide 56 is positioned between the moving member 74 and the intermediate stacker 32.

The coil spring 75 pushes the movable guide 56 in a direction separating away from the moving member 74. The movable guide 56 has an engaging portion 56*b* which engages with the moving member 74. The moving member 74 has a restricting portion 74*a* positioned at a position lower than the engaging portion 56*b* in the vertical direction Z and positioned between the engaging portion 56*b* and the intermediate stacker 32. The restricting portion 74*a* engages with the engaging portion 56*b*, and restricts movement of the movable guide 56 with respect to the movable member 74 in the direction separating away from the moving member 74.

Figure 23:
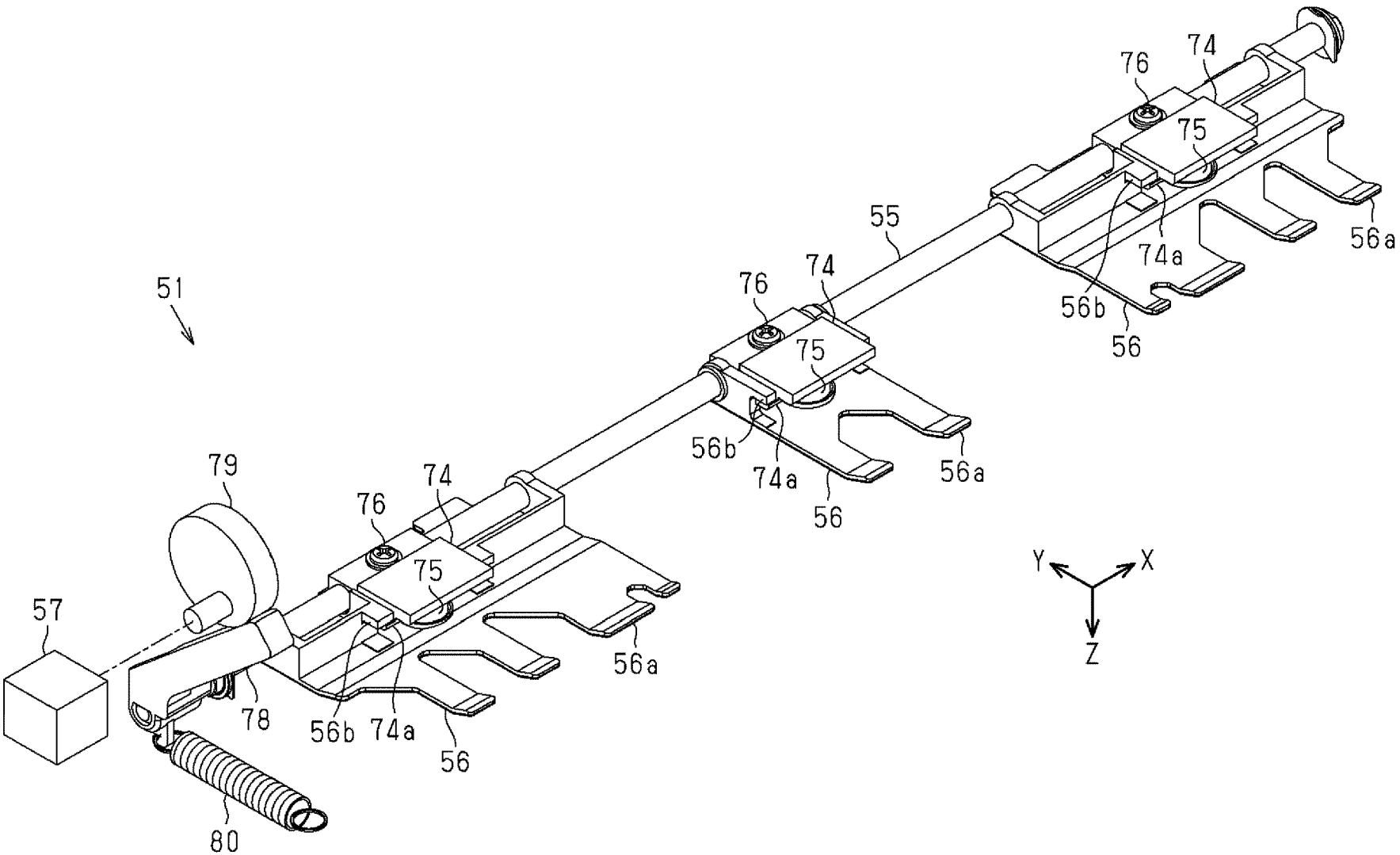
FIG. 23 is a perspective view of a change mechanism.

As shown in FIG. 23, the change mechanism 51 may include a lever 78 that is fixed to the guide shaft 55, a cam 79 that presses the lever 78, and a tension spring 80 that presses the lever 78 against the cam 79. The cam 79 is, for example, a substantially disk-shaped eccentric cam and has a shaft inserted into a position different from a center. The cam 79 is rotated by driving of the guide motor 57, and pushes the lever 78 against force of the tension spring 80.

When the cam 79 pushes the lever 78, the guide shaft 55 and the moving member 74 rotate in a clockwise direction in FIG. 22. The movable guide 56 pressed against the moving member 74 by the coil spring 75 rotates around the guide shaft 55 together with the moving member 74 in a state in which the engaging portion 56*b* is engaged with the restricting portion 74*a*. In other words, the movable guide 56 moves from the first guide position shown in FIG. 22 to the second guide position shown in FIG. 26.

When the cam 79 releases the pressing of the lever 78, the lever 78 returns to an original position by the force of the tension spring 80. The guide shaft 55 and the moving member 74 rotate in a counterclockwise direction in FIG. 22. The movable guide 56 in which the restricting portion 74*a* is engaged with the engaging portion 56*b* moves from the second guide position to the first guide position such that the engaging portion 56*b* is pushed up by the restricting portion 74*a*.

Next, an operation of the medium processing apparatus 11 will be described.

As shown in FIG. 22, when the medium 12 is transported in the first transport direction Y1 by the transport roller pair 19, the control unit 62 drives the fan 47 in a state in which the movable guide 56 is positioned at the first guide position in FIG. 22, and normally rotates and drives the belt motor 40 to rotate the transporting belt 29 in the first rotation direction A1.

Figure 24:
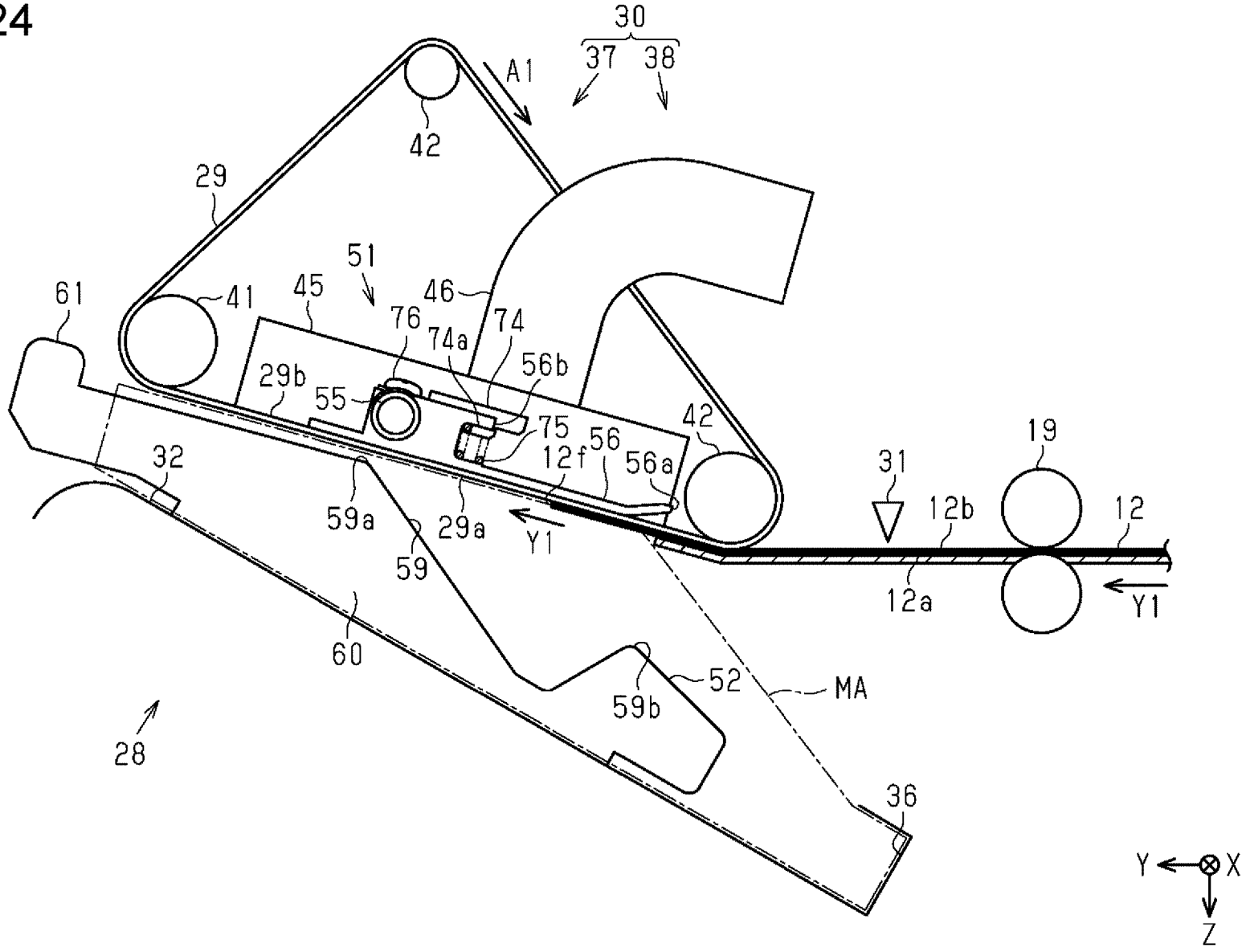
FIG. 24 is a schematic side view of the medium transporting apparatus in which the transporting belt suctions a medium.

As shown in FIG. 24, when the medium 12 is transported to the transporting belt 29, the suction mechanism 38 suctions the upper surface 12*b* of the medium 12. When the medium 12 is suctioned by the suction surface 29*a* and is transported in the first transport direction Y1 by the transporting belt 29 rotating in the first rotation direction A1, the movable guide 56 is positioned at the first guide position farther from the intermediate stacker 32 than the suction surface 29*a*. Therefore, the medium 12 is transported in the first transport direction Y1 in a state not in contact with the movable guide 56 or in a state of being along the movable guide 56.

Figure 25:
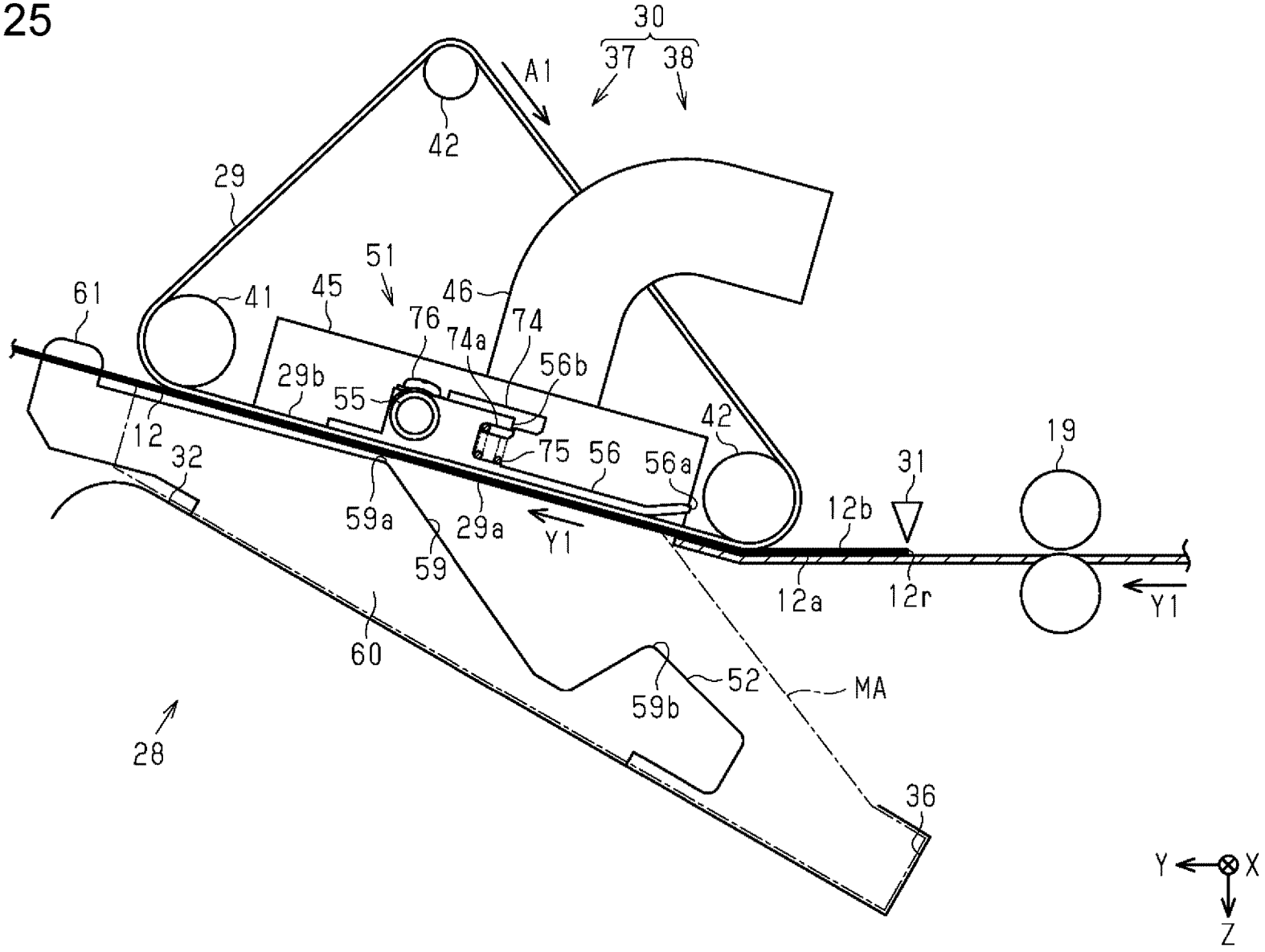
FIG. 25 is a schematic side view of the medium transporting apparatus which transports the suctioned medium in the first transport direction.

As shown in FIG. 25, when the detection unit 31 detects the rear end 12*r* of the medium 12, the control unit 62 normally rotates and drives the belt motor 40 for a predetermined time period, and then temporarily stops the drive of the belt motor 40.

Figure 26:
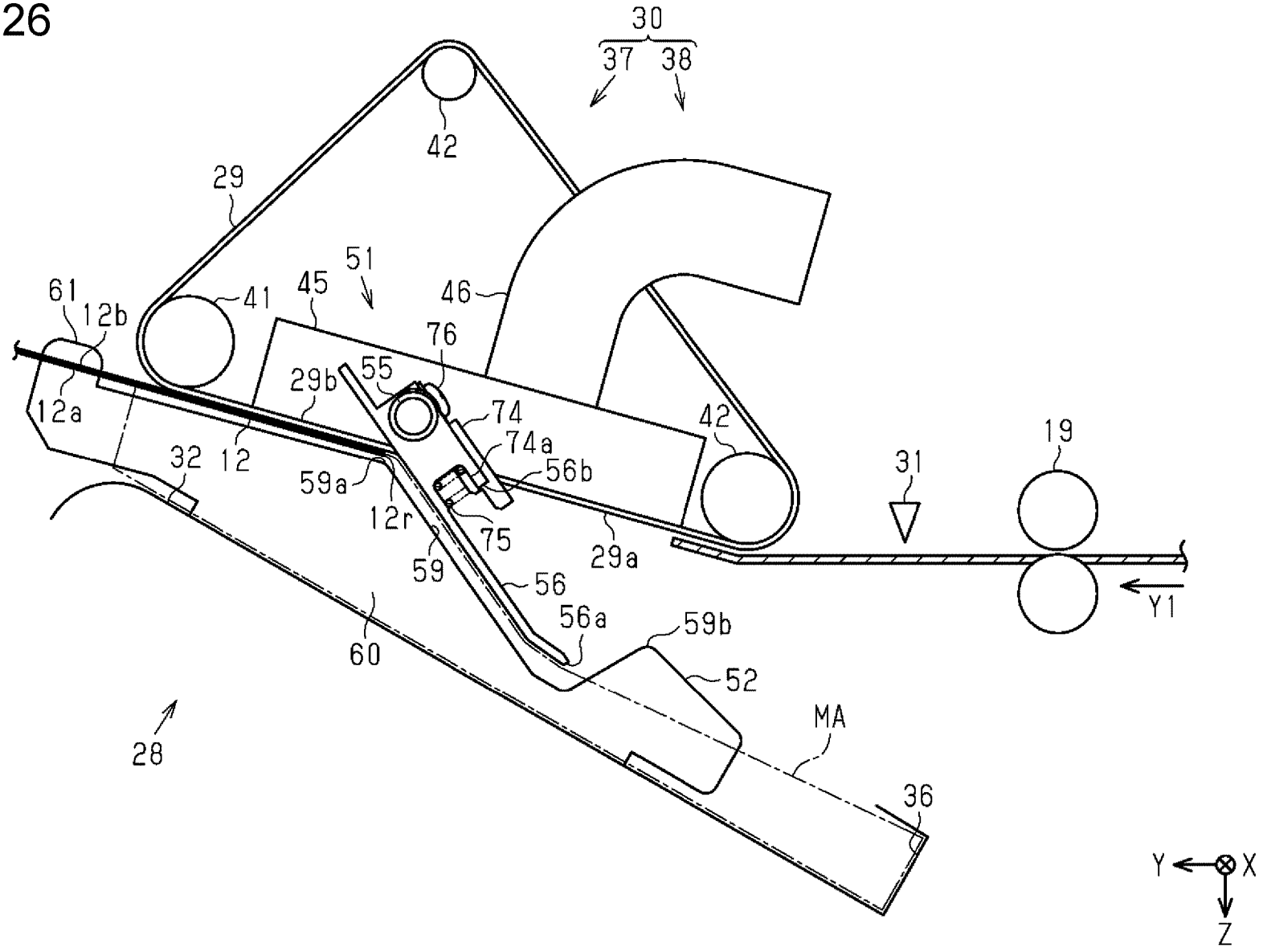
FIG. 26 is a schematic side view of the medium transporting apparatus when the rotation direction of the transporting belt is switched.

As shown in FIG. 26, when the rotation of the transporting belt 29 stops, the rear end 12*r* of the medium 12 is positioned downstream the guide shaft 55 in the first transport direction Y1. While the transport of the medium 12 is stopped, the control unit 62 moves the movable guide 56 to the second guide position. When the movable guide 56 is positioned at the second guide position, the size of the movable area MA is narrower as compared to that when the movable guide 56 is positioned at the first guide position.

The movable guide 56 positioned at the first guide position rotates and moves to the second guide position so that the tip 56*a* positioned downstream the guide shaft 55 in the second transport direction Y2 lowers. Therefore, when the movable guide 56 is positioned at the second guide position, the movable area MA is narrower on a downstream side in the second transport direction Y2 than the movable area MA when the movable guide 56 is positioned at the first guide position.

Figure 27:
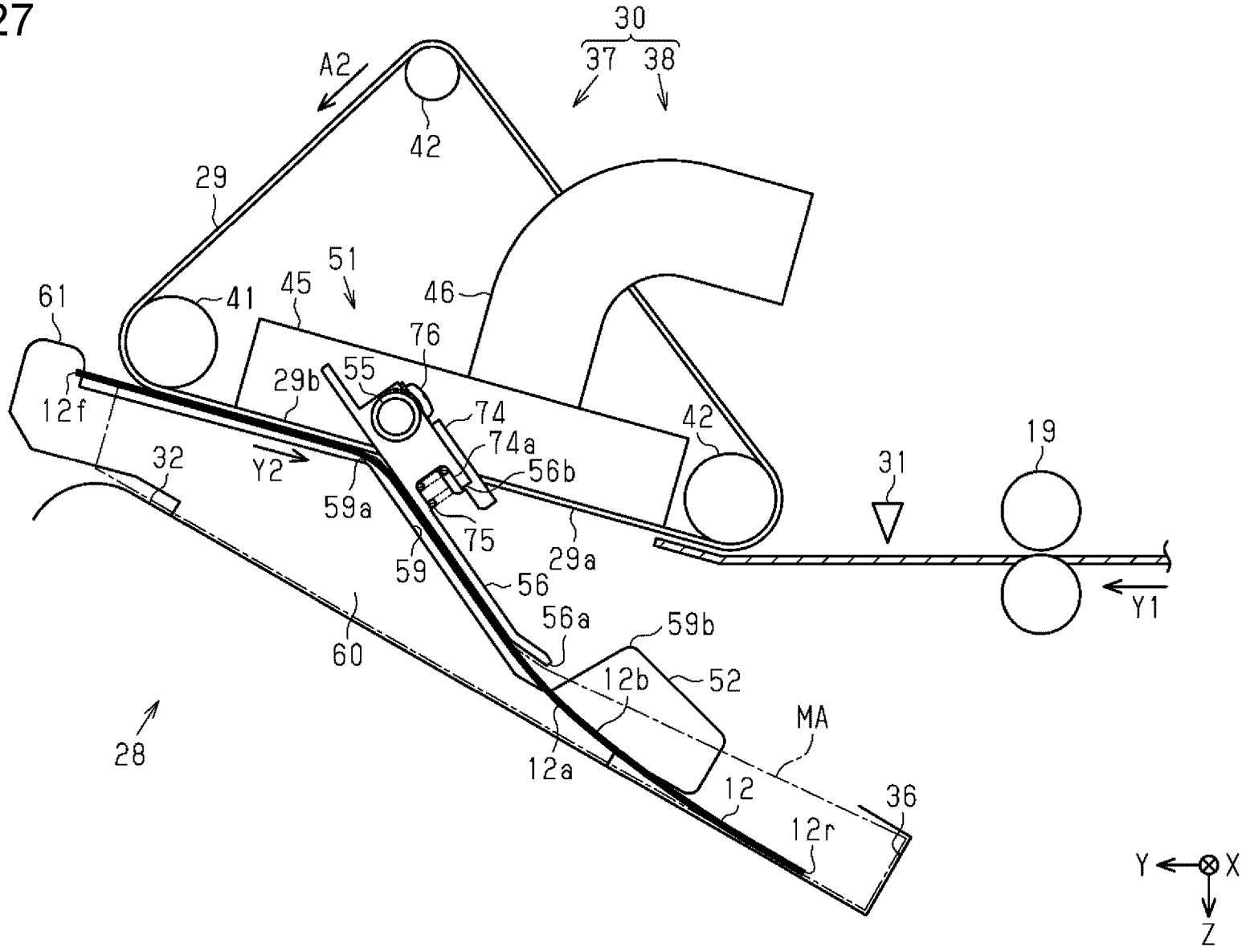
FIG. 27 is a schematic side view of the medium transporting apparatus which transports the medium in the second transport direction.

As shown in FIG. 27, the control unit 62 rotates the transporting belt 29 in the second rotation direction A2 in a state in which the movable guide 56 is positioned at the second guide position. When the transporting belt 29 rotates in the second rotation direction A2, the medium 12 is transported in the second transport direction Y2. The movable guide 56 positioned at the second guide position contacts the upper surface 12*b* of the medium 12 transported in the second transport direction Y2, and peels off the medium 12 from the suction surface 29*a*. The medium 12 peeled off from the suction surface 29*a* by the movable guide 56 is positioned by the rear end 12*r* abutting on the adjustment portion 36, and is stacked on the intermediate stacker 32 positioned below the transporting belt 29.

The control unit 62 may position the movable guide 56 at the second guide position until the detection unit 31 detects the next medium 12, and may maintain the movable area MA in a narrow state. By keeping the movable area MA narrow, it is possible to reduce a risk that the medium 12 curls in a state of being stacked on the intermediate stacker 32.

When the media 12 are not stacked on the intermediate stacker 32, a minimum distance between the movable guide 56 positioned at the second guide position and the intermediate stacker 32 is smaller than a thickness of the media 12 stackable on the intermediate stacker 32. Thus, when the thickness of media 12 stacked on the intermediate stacker 32 is greater than or equal to the minimum distance between the movable guide 56 and intermediate stacker 32, the movable guide 56 positioned at the second guide position contacts the media 12 stacked on intermediate stacker 32.

Figure 28:
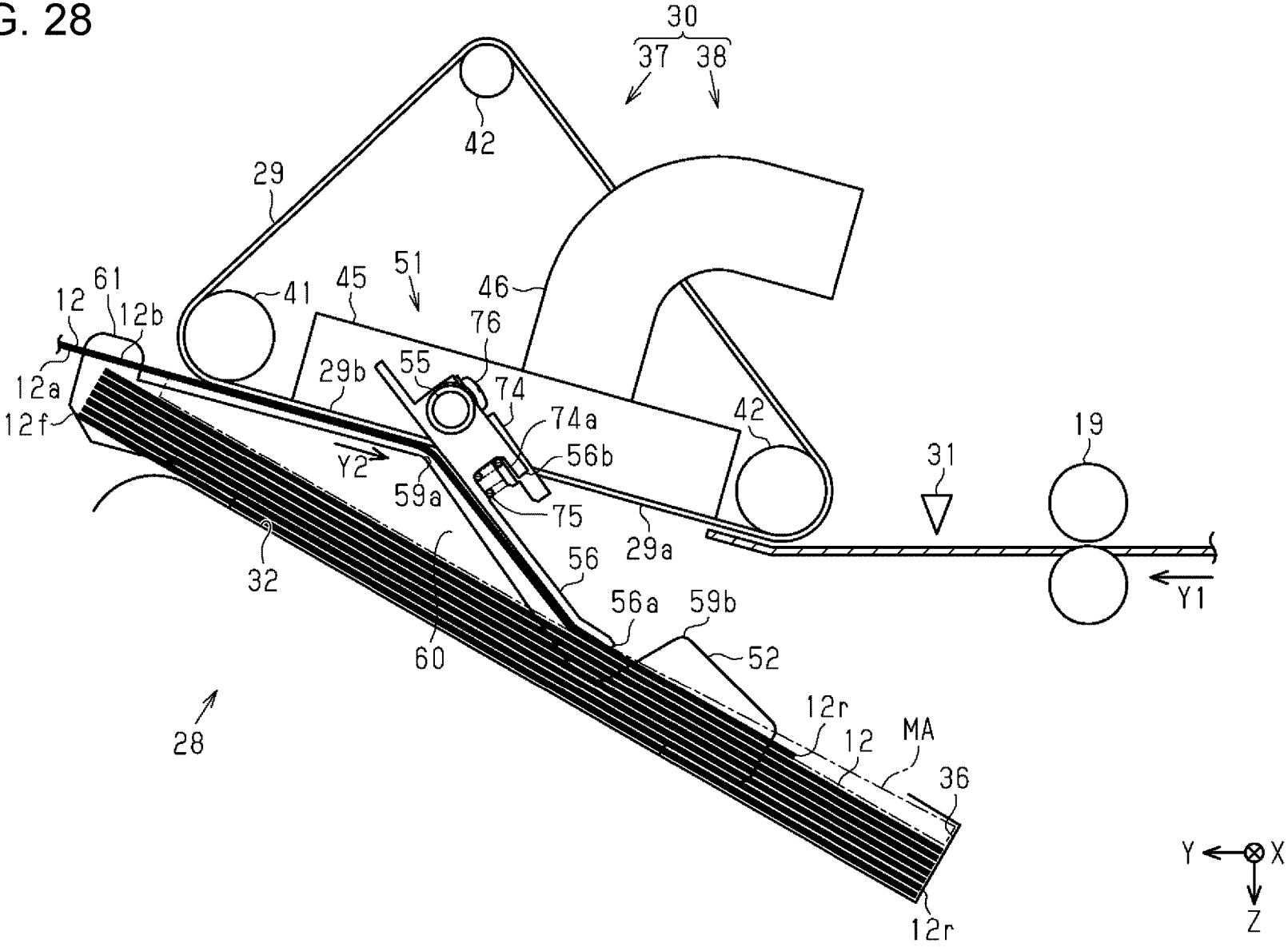
FIG. 28 is a schematic side view of the medium transporting apparatus for stacking a plurality of the media.

As shown in FIG. 28, when the media 12 are stacked on the intermediate stacker 32, an area between the media 12 stacked on the intermediate stacker 32 and the transporting belt 29 and an area between the media 12 stacked on the intermediate stacker 32 and the movable guide 56 become the movable area MA.

When the thickness of the media 12 stacked on the intermediate stacker 32 is equal to or greater than the minimum distance between the movable guide 56 and the intermediate stacker 32, a position where the movable guide 56 contacts the medium 12 stacked on the intermediate stacker 32 is the second guide position of the movable guide 56.

A portion of the movable guide 56 which contacts the medium 12 is positioned between the moving member 74 and the intermediate stacker 32. Therefore, when the movable guide 56 and the moving member 74 move from the first guide position so as to approach the intermediate stacker 32, the movable guide 56 contacts the medium 12 stacked on the intermediate stacker 32 earlier than the moving member 74. When the movable guide 56 which moves from the first guide position to the second guide position contacts the medium 12 stacked on the intermediate stacker 32, the movable guide 56 stops moving at a position in contact with the medium 12.

The moving member 74 is relatively movable with respect to the movable guide 56. The coil spring 75 contracts to allow movement of the moving member 74 with respect to the movable guide 56. The moving member 74 moves such that the restricting portion 74*a* moves away from the engaging portion 56*b* and approaches the intermediate stacker 32.

The second guide position of the movable guide 56 varies in accordance with the number of media 12 stacked on the intermediate stacker 32. Even when the number of the media 12 stacked on the intermediate stacker 32 varies, a position of the moving member 74 does not change when the movable guide 56 is positioned at the second guide position, and the second guide position of the movable guide 56 and a distance between the engaging portion 56*b* and the restricting portion 74*a* change.

When the medium 12 transported in the second transport direction Y2 contacts the movable guide 56 positioned at the second guide position, the movable guide 56 is pushed by this medium 12 and moves in a direction separating away from the intermediate stacker 32. That is, the medium 12 transported in the second transport direction Y2 passes between the medium 12 which is stacked earlier and the movable guide 56 so as to push up the movable guide 56, and is stacked on the intermediate stacker 32.

According to the above embodiment, it is possible to obtain the following effects.

4-1. The movable guide 56 positioned at the second guide position is contactable with the medium 12 stacked on the intermediate stacker 32, and is pushed by the medium 12 transported in the second transport direction Y2 and moves in the direction away from the intermediate stacker 32. Thus, the second guide position is a position at which the movable guide 56 contacts the medium 12 stacked on the intermediate stacker 32, and the second guide position can be automatically changed in accordance with the number of the media 12 stacked on the intermediate stacker 32.

The above embodiments may be modified as described in the following modification. The above embodiments and the following modifications may be arbitrarily combined. Configuration included in the following modification may be arbitrarily combined.

The post-processing apparatus 14 may be configured not to include the biasing member 66. For example, the separation flap 65 may be provided with a weight at a position opposite to a side in contact with the medium 12 with respect to the flap shaft 67, and the separation flap 65 positioned at the second flap position may be returned to the first flap position by own weight thereof. The post-processing apparatus 14 may include a drive source for moving the separation flap 65, such as a solenoid for moving the separation flap 65, or a motor for rotating the flap shaft 67, for example.

The post-processing apparatus 14 may include a roller such that the medium 12 is pinched between the roller and the transporting belt 29, and the roller follows and rotates in accordance with the transport of the medium 12. When this roller is a toothed roller having irregularities on peripheral surface thereof, it is possible to reduce a risk that liquid adhering to the lower surface 12*a* of the medium 12 subjected to the duplex printing is transferred to the roller.

The post-processing apparatus 14 may include a pressing member for pressing the media 12 stacked on the intermediate stacker 32. The pressing member is constituted by, for example, a plate-shaped elastic member which is rotatably provided, or a weight which is provided so as to be displaceable. When the transporting belt 29 rotates in the first rotation direction A1, the pressing member presses the medium 12 stacked on the intermediate stacker 32, and when the transporting belt 29 rotates in the second rotation direction A2, the pressing member moves to a position away from the medium 12.

The post-processing mechanism 33 may perform arbitrary processes as post-processing, such as a punch process for punching a hole in the medium 12, a shift process for shifting and discharging the medium 12 in a unit of copy, a cutting process for cutting the medium 12, a signature process for folding the medium 12, a bookbinding process and collation process for binding the medium 12, and the like.

The suction mechanism 38 may cause the transporting belt 29 to suction the medium 12 by an electrostatic suction method of charging the medium 12 and the transporting belt 29. When the suction mechanism 38 causes the transporting belt 29 to suction the medium 12 by the electrostatic suction method, it is possible to reduce a risk of damage to the medium 12 compared with a case where the medium 12 is transported by, for example, a sticky belt.

In the first embodiment and the second embodiment, the post-processing mechanism 33 may include the air blowing unit 71. In the third embodiment, the post-processing mechanism 33 may be configured not to include the air blowing unit 71.

In the first embodiment, the post-processing apparatus 14 may be configured not to include the moving mechanism 53. In other words, the adjusting member 52 does not need to be moved in the width direction X.

In the first embodiment, a configuration may be adopted in which no notch 59 is formed in the adjusting member 52.

In the first embodiment, the post-processing apparatus 14 may be configured not to include the adjusting member 52.

In the second embodiment, the post-processing apparatus 14 may include the adjusting member 52. A notch may be formed in the adjusting member 52 so as to allow the transporting belt 29 to move.

In the first embodiment, the movable guide 56 may be positioned at three or more of the second guide positions.

In the first embodiment, the second guide position does not need to be changed. The movable guide 56 may be positioned at the same second guide position regardless of the number of media 12 stacked on the intermediate stacker 32.

In the fourth embodiment, the change mechanism 51 may be configured not to include the coil spring 75. The movable guide 56 positioned at the second guide position may press the medium 12 stacked on the intermediate stacker 32 by own weight thereof.

In the fourth embodiment, the moving member 74 may be configured not to include the restricting portion 74*a*, and the movable guide 56 may be configured not to include the engaging portion 56*b*. For example, one end of the coil spring 75 may be connected with the moving member 74, another end of the coil spring 75 may be connected with the movable guide 56, and the moving member 74 may hold the movable guide 56 so as to be suspended by the coil spring 75. The change mechanism 51 may connect the moving member 74 and the movable guide 56 by a deformable member different from the coil spring 75.

In the change mechanisms 51, 69 and the moving mechanism 53, the size of the movable area MA between the transporting belt 29 and the intermediate stacker 32 when the medium 12 is transported in the first transport direction Y1 and when the medium 12 is transported in the second transport direction Y2 may be changed over the entire second transport direction Y2, or a size of an upstream side in the second transport direction Y2 may be changed.

The change mechanisms 51 and 69 may change the movable area MA while the transporting belt 29 rotates and the medium 12 is transported. For example, the change mechanism 51 may move the movable guide 56 from the first guide position to the second guide position after the rear end 12*r* of the medium 12 transported in the first transport direction Y1 passes through a portion where the suction surface 29*a* intersects with the movable guide 56 positioned at the second guide position. The change mechanism 51 may move the movable guide 56 from the first guide position to the second guide position, while the medium 12 is transported in the second transport direction Y2. The change mechanism 69 may move the transporting belt 29 from the first belt position to the second belt position, while the medium 12 having the rear end 12*r* suctioned by the suction surface 29*a* is transported in the first transport direction Y1 or the second transport direction Y2.

The medium processing apparatus 11 may be a device integrally provided with a function of the intermediate apparatus 15, a function of the post-processing apparatus 14, and a function of the printing apparatus 13.

The medium processing apparatus 11 may be a device that includes a device integrally provided with the function of the intermediate apparatus 15 and the function of the post-processing apparatus 14, and the printing apparatus 13.

The medium processing apparatus 11 may be configured not to include the intermediate apparatus 15 and the post-processing apparatus 14, and the printing apparatus 13 may be provided with the transporting mechanism 30 and a stacker for stacking the medium 12 transported by the transporting mechanism 30. The medium processing apparatus 11 may be configured not to include the post-processing mechanism 33. The medium processing apparatus 11 may transport the medium 12 subjected to the recording process by the recording head 27 in the first transport direction Y1 and the second transport direction Y2 by the transporting mechanism 30, and stack the medium 12 on the stacker included in the printing apparatus 13 so that the rear ends 12*r* of the media 12 are adjusted.

Liquid may be arbitrarily selected so long as the liquid enables the printing on the medium 12 by adhering to the medium 12. Note that, as the liquid, a substance in a liquid phase suffices, and liquid materials having high or low viscosity, sol, gel water, other inorganic solvents, organic solvents, solutions, liquid resin, liquid metal (metallic melt), and the like are included. Further, not only the liquid as a state of a substance but also a substance in which particles of a functional material composed of a solid matter such as a pigment, a metal particle or the like are dissolved, dispersed or mixed in a solvent is included. Representative examples of the liquid include ink. The ink includes common aqueous and oily inks as well as various liquid compositions such as gel inks, and hot melt inks.

The medium processing apparatus 11 is a device for printing a character, a painting, or an image such as a photograph by attaching liquid such as ink to the medium 12, and may be a serial printer, a lateral type printer, a line printer, a page printer, or the like. Further, the printing apparatus 13 may be an offset printing apparatus, a textile printing apparatus, or the like.

The medium processing apparatus 11 may be a scanner or a copying machine including a reading unit which is an example of a processing unit for reading and processing information recorded in the medium 12. The post-processing apparatus 14 and the medium transporting apparatus 28 may transport the discharged medium 12 after information is read by the reading unit.

The medium processing apparatus 11 may be a paper making apparatus including a paper making unit which is an example of a processing unit for manufacturing a paper which is an example of a medium. The post-processing apparatus 14 and the medium transporting apparatus 28 may transport media produced and discharged by the paper making unit.

Hereinafter, a technical idea and an operational effect will be described, which will be understood from the above-described embodiments and modifications.

A medium processing apparatus includes a processing unit for processing a medium, a suction mechanism for causing a loop transporting belt to suction the medium processed by the processing unit, a rotation mechanism for causing the transporting belt to rotate in a first rotation direction and in a second rotation direction opposite to the first rotation direction, a stacker for stacking the medium transported by the transporting belt, and a change mechanism for changing an area in which the medium is displaceable in a space between the transporting belt and the stacker, in which the suction mechanism suctions a second surface of the medium, opposite to a first surface on the stacker side, the rotation mechanism, after rotating the transporting belt suctioning the medium in the first rotation direction to transport the medium in a first transport direction, rotates the transporting belt in the second rotation direction to transport the medium in a second transport direction to stack the medium on the stacker, and the change mechanism narrows the area when the medium is transported in the second transport direction compared to an area when the medium is transported in the first transport direction.

The medium separated from the transporting belt deforms in the area in which the medium can be displaced. For this reason, there is a risk that as the area in which the medium can be displaced widens, the medium deforms largely. In this regard, according to this configuration, the change mechanism narrows the area in a space between the transporting belt and the stacker when the medium is transported in the second transport direction compared to an area when the medium is transported in the first transport direction. Accordingly, it is possible to prevent the medium transported in the second transport direction from being largely deformed after separated from the transporting belt, and to stack the medium on the stacker in a state in which the deformation of the medium is suppressed.

In the above medium processing apparatus, the change mechanism may include a movable guide that is movable between a first guide position and a second guide position closer to the stacker than the first guide position, and the movable guide positioned at the second guide position may contact the second surface of the medium transported in the second transport direction.

According to this configuration, the movable guide, when positioned at the second guide position closer to the stacker than the first guide position, contacts the second surface of the medium. Therefore, it is possible to peel off the medium from the transporting belt by the movable guide positioned at the second guide position and to narrow the area in which the medium can be displaced.

In the medium processing apparatus, the second guide position may be changed in accordance with the number of the media stacked on the stacker, and a distance between the movable guide positioned at the second guide position and the stacker when the number of the media stacked is large, may be larger than a distance between the movable guide positioned at the second guide position and the stacker when the number of the media stacked is small.

According to this configuration, the second guide position of the movable guide changes in accordance with the number of the media stacked on the stacker. Therefore, relationship between the movable guide positioned at the second guide position and the medium stacked on the stacker can be appropriately maintained.

The medium processing apparatus may further include a control unit that controls the second guide position of the movable guide so as to vary in accordance with the number of the media stacked on the stacker.

According to this configuration, the second guide position of the movable guide is controlled by the control unit so as to vary in accordance with the number of media stacked on the stacker. Therefore, it is possible to reduce a risk that the movable guide contacts the medium stacked on the stacker.

In the medium processing apparatus, the movable guide positioned at the second guide position is contactable with the medium stacked on the stacker, and may be pushed by the medium transported in the second transport direction and move in a direction separating away from the stacker.

According to this configuration, the movable guide positioned at the second guide position is contactable with the medium stacked on the stacker, and is pushed by the medium transported in the second transport direction and moves in the direction separating away from the stacker. Thus, the second guide position is a position at which the movable guide contacts the media stacked on the stacker, and the second guide position can be automatically changed in accordance with the number of the media stacked on the stacker.

The medium processing apparatus may further include a pair of adjusting members that adjusts the medium stacked on the stacker in a width direction orthogonal to the first transport direction, and a notch may be formed on the adjusting member, which avoids contact with the movable guide positioned at the second guide position in an operation in which the adjusting member adjusts the medium.

According to this configuration, the notches are formed in the pair of adjusting members included in the stacker. Therefore, it is possible to reduce a risk that the movable guide positioned at the second guide position and the adjusting member interfere with each other.

In the medium processing apparatus, the transporting belt may be provided so as to be movable between a first belt position and a second belt position closer to the stacker than the first belt position, and the change mechanism may position the transporting belt at the first belt position when the medium is transported in the first transport direction, and may position the transporting belt in the second belt position when the medium is transported in the second transport direction.

According to this configuration, when the medium is transported in the first transport direction, the change mechanism positions the transporting belt at the first belt position, and when the medium is transported in the second transport direction, the change mechanism positions the transporting belt in the second belt position that is closer to the stacker than the first belt position. Therefore, the area in which the medium can be displaced can be narrowed by the transporting belt, and the medium can be stacked on the stacker in a state in which the transporting belt is close to the stacker, so that the medium can be stacked quickly.

The medium processing apparatus may further include a pair of adjusting members that moves relatively in a width direction orthogonal to the first transport direction to adjust the medium stacked on the stacker, and the adjusting member may include a first guide surface that adjusts an end of the medium, and a second guide surface that is at a position close to a side of the transporting belt than the first guide surface, and guides a side of the first surface of the medium on an inner side of the first guide surface in the width direction.

According to this configuration, a distance between the pair of second guide surfaces in the width direction is narrower than a distance between the pair of the first guide surfaces. Therefore, when the first guide surface and an end of the medium contact with each other and the next medium is transported in the second transport direction in a state in which the adjusting member adjusts the medium, the next medium is guided by the second guide surface. Since the second guide surface is positioned closer to the transporting belt side than the first guide surface, the area in which the media can be displaced can be narrowed by the second guide surface.

The medium processing apparatus may further include an air blowing unit that blows air toward the first surface of the medium when the medium is transported in the second transport direction.

According to this configuration, the air blowing unit that blows the air toward the first surface of the medium is included. Therefore, it is possible to stabilize behavior of the medium that is separated from the transporting belt.

In the medium processing apparatus, the suction mechanism may cause the transporting belt to suction the medium by a draw-in method in which air is drawn in through holes formed in the transporting belt or by an electrostatic suction method in which the medium and the transporting belt are electrically charged.

According to this configuration, the suction mechanism makes the transporting belt suction the medium by the draw-in method or the electrostatic suction method. Thus, it is possible to reduce a risk that the medium is damaged as compared with a case where the medium is transported by, for example, a sticky belt.

A post-processing apparatus includes a suction mechanism for causing a loop transporting belt to suction a discharged medium, a rotation mechanism for causing the transporting belt to rotate in a first rotation direction and in a second rotation direction opposite to the first rotation direction, an intermediate stacker for stacking the medium transported by the transporting belt, a post-processing mechanism for performing post-processing on the medium stacked on the intermediate stacker, a discharging stacker for stacking the medium delivered from the intermediate stacker, and a change mechanism for changing an area in which the medium is displaceable between the transporting belt and the intermediate stacker, in which the suction mechanism suctions a second surface of the medium, opposite to a first surface on a side of the intermediate stacker, the rotation mechanism, after causing the transporting belt suctioning the medium to rotate in the first rotation direction to transport the medium in a first transport direction, causes the transporting belt to rotate in the second rotation direction to transport the medium in a second transport direction to stack the medium on the intermediate stacker, and the change mechanism narrows the area when the medium is transported in the second transport direction compared to an area when the medium is transported in the first transport direction. According to this configuration, it is possible to obtain an effect similar to that of the medium processing apparatus.

A medium transporting apparatus includes a suction mechanism for causing a loop transporting belt to suction a discharged medium, a rotation mechanism for causing the transporting belt to rotate in a first rotation direction and in a second rotation direction opposite to the first rotation direction, a stacker for stacking the medium transported by the transporting belt, and a change mechanism for changing an area in which the medium is displaceable in a space between the transporting belt and the stacker, in which the suction mechanism suctions a second surface of the medium, opposite to a first surface on a side of the stacker, the rotation mechanism, after causing the transporting belt suctioning the medium to rotate in the first rotation direction to transport the medium in a first transport direction, causes the transporting belt to rotate in the second rotation direction to transport the medium in a second transport direction to stack the medium on the stacker, and the change mechanism narrows the area when the medium is transported in the second transport direction compared to an area when the medium is transported in the first transport direction. According to this configuration, it is possible to obtain an effect similar to that of the medium processing apparatus.

What is claimed is:

1. A medium processing apparatus, comprising:

a processing unit for processing a medium;

a suction mechanism for suctioning a loop transporting belt the medium processed by the processing unit;

a rotation mechanism for rotating the transporting belt in a first rotation direction and in a second rotation direction opposite to the first rotation direction;

a stacker for stacking the medium transported by the transporting belt; and a change mechanism for changing an area in which the medium is displaceable in a space between the transporting belt and the stacker, wherein the suction mechanism suctions a second surface of the medium, which is on an opposite side of the medium from a stacker-side first surface, to the transport belt, the rotation mechanism, after suctioning the medium to the transporting belt to rotate in the first rotation direction to transport the medium in a first transport direction, rotates the transporting belt in the second rotation direction to transport the medium in a second transport direction to stack the medium on the stacker, and the change mechanism narrows the area when the medium is transported in the second transport direction compared to an area when the medium is transported in the first transport direction.

2. The medium processing apparatus according to claim 1, wherein the change mechanism includes a movable guide that is movable between a first guide position and a second guide position closer to the stacker than to the first guide position, and the movable guide positioned at the second guide position contacts the second surface of the medium transported in the second transport direction.

3. The medium processing apparatus according to claim 2, wherein the second guide position is changed in accordance with a number of the media stacked on the stacker, and a distance between the movable guide positioned at the second guide position and the stacker when the number of the media stacked is large, is larger than a distance between the movable guide positioned at the second guide position and the stacker when the number of the media stacked is small.

4. The medium processing apparatus according to claim 3, further comprising:

a control unit that controls the second guide position of the movable guide in accordance with the number of the media stacked on the stacker.

5. The medium processing apparatus according to claim 3, wherein the movable guide positioned at the second guide position is contactable with the medium stacked on the stacker, is pushed by the medium transported in the second transport direction and moves in a direction separating away from the stacker.

6. The medium processing apparatus according to claim 2, further comprising:

a pair of adjusting members that adjusts, in a width direction orthogonal to the first transport direction, the medium stacked on the stacker, wherein a notch is formed on the adjusting member, which avoids contact with the movable guide positioned at the second guide position in an operation in which the adjusting member adjusts the medium.

7. The medium processing apparatus according to claim 1, wherein the transporting belt is movable between a first belt position and a second belt position closer to the stacker than the first belt position, and the change mechanism positions the transporting belt at the first belt position when the medium is transported in the first transport direction, and positions the transporting belt in the second belt position when the medium is moved in the second transport direction.

8. The medium processing apparatus according to claim 1, further comprising:

a pair of adjusting members that moves relatively in a width direction orthogonal to the first transport direction to adjust the medium stacked on the stacker, wherein the adjusting member includes a first guide surface that adjusts an end of the medium in the width direction, and a second guide surface that is at a position closer to the transporting belt than the first guide surface, and guides the first surface of the medium on an inner side of the first guide surface in the width direction.

9. The medium processing apparatus according to claim 8, further comprising:

an air blowing unit that blows air toward the first surface of the medium when the medium is transported in the second transport direction.

10. The medium processing apparatus according to claim 1, wherein the suction mechanism suctions the transporting belt the medium by a draw-in unit in which air is drawn in through holes formed in the transporting belt or by an electrostatic suction unit in which the medium and the transporting belt are made electrically charged.

11. A post-processing apparatus, comprising:

a suction mechanism for suctioning a discharged medium to a loop transporting belt a discharged medium;

a rotation mechanism for rotating the transporting belt in a first rotation direction and in a second rotation direction opposite to the first rotation direction;

an intermediate stacker for stacking the medium transported by the transporting belt;

a post-processing mechanism for performing post-processing on the medium stacked on the intermediate stacker;

a discharging stacker for stacking the medium delivered from the intermediate stacker; and a change mechanism for changing an area in which the medium is displaceable between the transporting belt and the intermediate stacker, wherein the suction mechanism suctions a second surface of the medium, which is on an opposite side of the medium from a stacker-side first surface, to the transport belt, the rotation mechanism, after suctioning the medium to the transporting belt to rotate in the first rotation direction to transport the medium in a first transport direction, rotates the transporting belt in the second rotation direction to transport the medium in a second transport direction to stack the medium on the intermediate stacker, and the change mechanism narrows the area when the medium is transported in the second transport direction compared to an area when the medium is transported in the first transport direction.

12. A medium transporting apparatus, comprising:

a suction mechanism for suctioning a discharged medium to a loop transporting belt;

a rotation mechanism for rotating the transporting belt in a first rotation direction and in a second rotation direction opposite to the first rotation direction;

a stacker for stacking the medium transported by the transporting belt; and a change mechanism for changing an area in which the medium is displaceable in a space between the transporting belt and the stacker, wherein the suction mechanism suctions a second surface of the medium, which is on opposite side of the medium from a stacker-side first surface, to the transport belt, the rotation mechanism, after suctioning the medium to the transporting belt to rotate in the first rotation direction to transport the medium in a first transport direction, rotating the transporting belt in the second rotation direction to transport the medium in a second transport direction to stack the medium on the stacker, and the change mechanism narrows the area when the medium is transported in the second transport direction compared to an area when the medium is transported in the first transport direction.

* * * * *